US006681493B2

(12) United States Patent
Mori et al.

(10) Patent No.: US 6,681,493 B2
(45) Date of Patent: Jan. 27, 2004

(54) CIRCULAR SAWS HAVING BEVEL ANGLE SETTING MECHANISM

(75) Inventors: Shinsuke Mori, Anjo (JP); Katsumi Okouchi, Anjo (JP)

(73) Assignee: Makita Corporation, Anjo (JP)

( * ) Notice: Subject to any disclaimer, the term of this patent is extended or adjusted under 35 U.S.C. 154(b) by 177 days.

(21) Appl. No.: 09/736,216

(22) Filed: Dec. 15, 2000

(65) Prior Publication Data

US 2001/0037578 A1 Nov. 8, 2001

(30) Foreign Application Priority Data

Dec. 16, 1999 (JP) ..... 11-357995
Jun. 1, 2000 (JP) ..... 2000-165017

(51) Int. Cl.[7] ..... B27B 9/02
(52) U.S. Cl. ..... 30/376; 30/391
(58) Field of Search ..... 30/376, 391

(56) References Cited

U.S. PATENT DOCUMENTS

| | | | | | |
|---|---|---|---|---|---|
| 1,830,580 | A | * | 11/1931 | Wappat | 30/376 |
| 1,848,330 | A | * | 3/1932 | Emmons | 30/376 |
| 1,854,510 | A | * | 4/1932 | Haas | 30/376 |
| 2,558,829 | A | * | 7/1951 | Dolan | 30/376 |
| 2,657,719 | A | * | 11/1953 | Forsberg | 30/376 |
| 2,955,629 | A | * | 10/1960 | Bork | 30/376 |
| 3,262,472 | A | * | 7/1966 | McCarthy et al. | 30/376 |
| 3,292,673 | A | * | 12/1966 | Gregory | 30/377 |
| 3,977,080 | A | * | 8/1976 | Allaire | 30/376 |
| 4,999,916 | A | | 3/1991 | Sistare | |
| 5,121,545 | A | * | 6/1992 | Nonaka et al. | 30/376 |
| 5,271,155 | A | * | 12/1993 | Fuchs et al. | 30/376 |
| 5,433,008 | A | | 7/1995 | Barger, Jr. et al. | |
| 5,452,515 | A | * | 9/1995 | Schilling | 30/376 |
| 5,517,763 | A | * | 5/1996 | Schilling et al. | 30/376 |
| 5,570,511 | A | * | 11/1996 | Reich et al. | 30/376 |
| D378,488 | S | * | 3/1997 | Ito et al. | D8/66 |
| 5,873,169 | A | * | 2/1999 | James et al. | 30/376 |
| D411,425 | S | * | 6/1999 | Sugimoto et al. | D8/66 |
| 6,202,311 | B1 | * | 3/2001 | Nickels, Jr. | 30/376 |
| 6,557,261 | B1 | * | 5/2003 | Buser et al. | 30/391 |
| 6,574,874 | B2 | * | 6/2003 | Hartmann | 30/376 |
| 6,601,305 | B1 | * | 8/2003 | Fukuoka | 30/376 |

FOREIGN PATENT DOCUMENTS

| | | |
|---|---|---|
| DE | 2641666 | 4/1977 |
| DE | 4300033 | 7/1994 |
| DE | 4403186 | 8/1995 |
| DE | 19523348 | 1/1996 |

OTHER PUBLICATIONS

U.S. patent application Ser. No. 09/637,906, Fukuoka, filed Aug. 14, 2000.

* cited by examiner

*Primary Examiner*—Allen N. Shoap
*Assistant Examiner*—Jason Prone
(74) *Attorney, Agent, or Firm*—Dennison, Schultz & Dougherty

(57) ABSTRACT

Portable circular saws are taught that may include a base and a saw unit pivotally coupled to the base. The saw unit may have a circular saw blade that is adapted to laterally pivot relative to the base. A stopper may be provided to allow an operator to selectively stop the saw unit at a second pivot angle that is between a first pivot angle and a third pivot angle. Preferably, the stopper may have an operative position and a non-operative position. In the operative position, the saw unit can pivot from the first pivot angle to the third pivot angle without stopping at the second pivot angle. In the non-operative position, the saw unit can pivot between the first pivot angle and the second pivot angle. A first stopper may be provided to permit the saw to be selectively stopped at a small angle pivot position (e.g. 0°) before a minimum pivot angle (e.g. −5°). A second stopper may be provided to permit the saw to be selectively stopped at a large angle pivot position (e.g. 45°) before a maximum pivot angle (e.g. 50°).

26 Claims, 31 Drawing Sheets

CIRCULAR SAWS HAVING BEVEL ANGLE SETTING MECHANISM

BACKGROUND OF THE INVENTION

1. Field of the Invention

The present invention relates to circular saws, and in particular to portable circular saws that have a saw unit inclining mechanism for laterally inclining or pivoting a saw blade with respect to a workpiece. The saw units may, for example, selectively stop in preferred bevel positions depending upon whether a stopper is set to an operative position or a non-operative position.

2. Description of the Related Art

Known portable circular saws comprise a base adapted to contact a workpiece and a saw unit that has a circular saw blade. A lower portion of the saw blade protrudes downwardly through the base so as to cut the workpiece. The circular saw unit can move vertically relative to the base (i.e. in a direction perpendicular to the rotational axis of the saw blade), so that the downward protruding distance of the saw blade from the base can be changed. Thus, the cutting depth can be adjusted. In addition, the circular saw can laterally pivot relative to the base (i.e. in a lateral direction with respect to the saw blade), so that a bevel cutting operation can be performed with the saw blade laterally inclined relative to the workpiece. The incline angle of the saw blade can also be adjusted.

In general, the lateral pivotal position of the saw unit can be adjusted between a 0° position and a 45° position. In the 0° position, the saw blade is perpendicular to the base or the workpiece, so that a normal (vertical) cutting operation can be performed. In the 45° position, the saw blade is inclined at an angle of 45° relative to the base or the workpiece. This 45° position is most frequently selected when a laterally inclined (bevel) cutting operation is performed. This position is referred to as a "standard inclined position" in this description. A stopper device serves to prevent the saw unit from pivoting from the 0° position to a position less than 0° and also from pivoting from the 45° position to a position more than 45°. Therefore, the operator can easily and reliably position the saw unit at either the 0° position or the 45° position.

U.S. Pat. Nos. 5,433,008 and 4,999,916 teach portable circular saws that have a stopper device to stop the inclination of the saw unit selectively at the standard inclined position and at an extra inclined position, in which the circular saw is inclined by an angle of more than 45°.

FIGS. 1 and 3 of U.S. Pat. No. 4,999,916 have been incorporated into the drawings of this application as FIGS. 41 and 42, respectively. FIGS. 41 and 42 show a front view of a portable circular saw and an enlarged front view of a part of the portable circular saw, respectively. As shown in FIG. 41, a portable circular saw 101 comprises a base 102 and a saw unit 104. A circular saw blade 103 is mounted on the saw unit 104 and serves to cut a workpiece W. The saw unit 104 is laterally pivotable relative to the base 102 by means of a pivot shaft 105.

An angular plate 121 is secured to the base 121 and has an arc-shaped guide slot 121*a* that extends along an arc about the pivot shaft 105. A substantially L-shaped second guide slot 121*b* is formed in series with the upper end of the guide slot 121*a*.

An angular guide 123 is secured to the saw unit 104 and is pivotally supported by the pivot shaft 105. A substantially L-shaped guide slot 123*a* is formed in the angular guide 123. A lock screw 126 is inserted through the guide slot 123*a* of the angular guide 123 and the guide slot 121*a* of the angular plate 121 and is engaged with a nut (not shown).

In order to laterally incline the saw unit 104 or the saw blade 103 from a 0° position shown in FIG. 41 to a 45° position shown in FIG. 42, the operator pivots the saw unit 104 in a counterclockwise direction. The pivotal movement of the saw unit 104 stops at the 45° position when the lock screw 126 abuts the upper end of the guide slot 121*a* of the angular plate 121. The saw unit 104 can be fixed in this position by tightening the lock screw 126 and the nut so as to fix the angular guide 123 to the angular plate 121.

In order to further laterally incline the saw unit 104 from the 45° position to a 50° position, the operator must loosen the lock screw 126 and then shift the lock screw 126 into the second guide slot 121*b* of the angular plate 121. During the movement of the lock screw 126 along the guide slots 121*a* and 121*b*, the lock screw 126 also moves along the guide slot 123*a* of the angular guide 123. The pivotal movement of the saw unit 104 stops at the 50° position when the lock screw 126 abuts the upper end of the second guide slot 121*b* of the angular plate 121. The saw unit 104 can be fixed in this position by tightening the lock screw 126.

FIG. 5 of U.S. Pat. No. 5,433,008 has been incorporated into the drawings of this application as FIG. 43. As shown in FIG. 43, a lateral inclining device 200 comprises an upright guide plate 202 that is secured to a base 201. An arc-shaped slot 203 is formed in the guide plate 202. A saw unit (not shown in FIG. 43) can pivot about a pivot shaft 205 and has a lock screw 204 that is inserted into the arc-shaped slot 203 and that can move along the arc-shaped slot 203. A stopper screw 207 is mounted on the guide plate 202 at one end of the arc-shaped slot 203 and opposes the lock screw 204. A disk member is rotatably mounted on the lock screw 204 and has legs 206 positioned on both sides of the lock screw 204.

In order to prevent the saw unit from pivoting more than an inclined angle of 45° (i.e., the standard inclined position), the disc is rotated to a position in which one of the legs 206 opposes the stopper screw 204. The operator then pivots the saw unit, so that one of the legs 206 contacts the stopper screw 204 when the saw unit reaches the 45° position. The operator thereafter tightens the lock screw 204, so that the saw unit can be fixed in position at the 45° position.

In order to move the saw unit to an extra inclined position that is past the 45° position, the operator must rotate the disk member by an angle of 90° while the stopper screw 204 is disposed within an enlarged end portion 203*a* of the slot 203, so that the lock screw 204 directly opposes the stopper screw 207. As a result, the saw unit can be fixed at the extra inclined position as shown in FIG. 43, in which the lock screw 204 directly contacts the lock screw 207.

However, in both the above U.S. patents, in order to change the stop position of the saw unit from the 45° inclined position to the extra inclined position that is more than 45°, or from the extra inclined position to the 45° inclined position, the operator must perform a cumbersome operation. That is, the saw unit can not freely move from the 0° position to the 50° position. Instead, the operator must always stop at the 45° position and adjust the stopper device before moving past the 45° position.

For example, in U.S. Pat. No. 4,999,916, in order to change the stop position, the lock screw 129 must be shifted from the first guide recess 126 to the second guide recess 128 or from the second guide recess 128 to the first guide recess 126 with the lock screw 129 positioned at about the upper end of the first guide recess 126, in which the saw unit 123 is inclined at an angle of about 45°.

Likewise, in U.S. Pat. No. 5,433,008, in order to change the stop position, the disc must be rotated to change the position of the legs 206 with the stopper screw 204 positioned within the enlarged end portion 203*a* of the guide slot 203. Thus, the pivotal movement of the saw unit must be first stopped at about the 45° inclined position and then the disc must be rotated to further pivotally move the saw unit.

SUMMARY OF THE INVENTION

It is, accordingly, one object of the present invention to teach improved portable circular saws. Preferably, such portable circular saws can simplify the operation of setting the bevel or incline angle of the saw blade relative to a base.

In one aspect of the present teachings, portable circular saws may include improved stopper devices that can simplify the operation of changing the pivot angle of the saw blade with respect to the base. Preferably, the saw unit may be pivoted with respect to the base between a first pivot angle and a third pivot angle. A stopper may be provided to selectively stop the saw unit at a second pivot angle that is between the first pivot angle and the third pivot angle. When the stopper is in an operative position, the pivot range of the saw unit will be limited to between the first pivot angle and the second pivot angle. Therefore, in this state, the operator can easily and reliably pivot the saw unit from the first pivot angle to the second pivot angle. On the other hand, when the stopper is in a non-operative position, the pivot range of the saw unit is between the first pivot angle and the third pivot angle. Further, the stopper will not interfere with movement of the saw unit through the second pivot angle when the stopper is in the non-operative position. Therefore, the saw unit can be easily and reliably positioned in the first pivot angle or the third pivot angle (or an angle therebetween) and the operator is not required to take any action to move the saw unit past the second pivot angle. Thus, the pivot angle of the circular saws of the present teachings can be more easily set than, for example, the circular saws of the above-described known circular saws, in which the saw unit must stop in the second pivot angle position.

By way of illustration, the first pivot angle, second pivot angle and third pivot angle for a portable circular saw may be 0°, 45° and 50°, respectively. Naturally, other pivot angles may be selected as the first pivot angle, second pivot angle and the third pivot angle. In this case, the stopper may permit the operator to selectively stop the saw unit in either of the 45° position (i.e. second pivot angle) or the 50° position (i.e. the third pivot angle). If the stopper is in the non-operative position, the saw unit may freely pivot from a pivot angle less than 45° to a pivot angle greater than 45° without interference of the stopper. If the stopper is in the operative position, the saw unit will stop at the 45° position and will not travel past the 45° position, unless the stopper is set to the non-operative position. Thus, the operator can easily and reliable pivot the saw unit between the 0° position and the 45° position with the stopper in the operative position.

In some circumstances, the operator may wish to alternatively cut a workpiece with the saw unit in the 0° position and then with the saw unit in the 50° position. If the stopper is set to the non-operative position, the operator can easily pivot the saw unit between the 0° position and the 50° position without being required to operate a stopper device at the 45° position. Thus, the present circular saws are advantageous over the known circular saws that were described above. The operator may later wish to alternatively cut a workpiece with the saw unit in the 0° position and with the saw unit in the 45° position. If the stopper is set to the operative position, the operator can easily pivot the saw unit between the 0° position and the 45° position. Thus, the present circular saws are particularly easy and reliable to use for bevel cutting operations.

In another preferred example, a lock screw may travel within a guide slot and the terminal ends of the guide slot may define the first pivot angle (e.g. 0°) and the third pivot angle (e.g. 50°). The stopper may be selectively activated to stop the saw blade in the second pivot angle (e.g. 45°). Thus, if the stopper is set to the non-operative position, the saw unit can freely travel between the 0° position and the 50° position without interference of the stopper. However, if the stopper is set to the operative position, the saw unit will stop at the 45° position and not pass to the 50° position unless the stopper is changed to the non-operative position The lock screw may be utilized to fix the preferred pivot angle between the saw unit and the base during the cutting operation.

In another preferred example, the saw unit may preferably stop in a minus pivot angle position that is less than the first pivot angle, e.g. −5° position. That is, the minus angle position may be opposite of the vertical position (e.g. 0°) from the second and third pivot angles (positive angle positions). This minus pivot angle position permits the operator to make additional useful cuts with the portable circular saw. For example, one terminal end of the guide slot may extend to the −5° position and a stopper may be provided to selectively stop the saw unit at the first pivot angle (e.g. 0°). Thus, if the stopper is set to the non-operative position, the saw unit may freely travel to the minus angle position, e.g. −5°, from the positive angle positions. However, if the stopper is set to the operative position, the saw unit will stop at the first pivot angle (e.g. 0°) and will not travel to a minus angle position, unless the stopper is set to the non-operative position. Thus, the stopper also permits the operator to easily and reliable change between a positive angle position and a minus angle position without stopping at the first pivot angle (e.g. 0°), if the stopper is set to the non-operative position.

Of course, the above described stoppers may be utilized singularly or in combination.

Further, fine adjustment mechanisms are taught to permit the operator to finely adjust, for example, the 0° position and/or the 45° position of the saw unit with respect to the base. These fine adjustment mechanisms also may be utilized singularly or in combination. Moreover, such fine adjustment mechanisms may be utilized separately from the above-described stoppers.

Other objects, features and advantages of the present invention will be readily understood after reading the following detailed description together with the accompanying drawings and the claims.

DETAILED DESCRIPTION OF THE INVENTION

Figure 1:
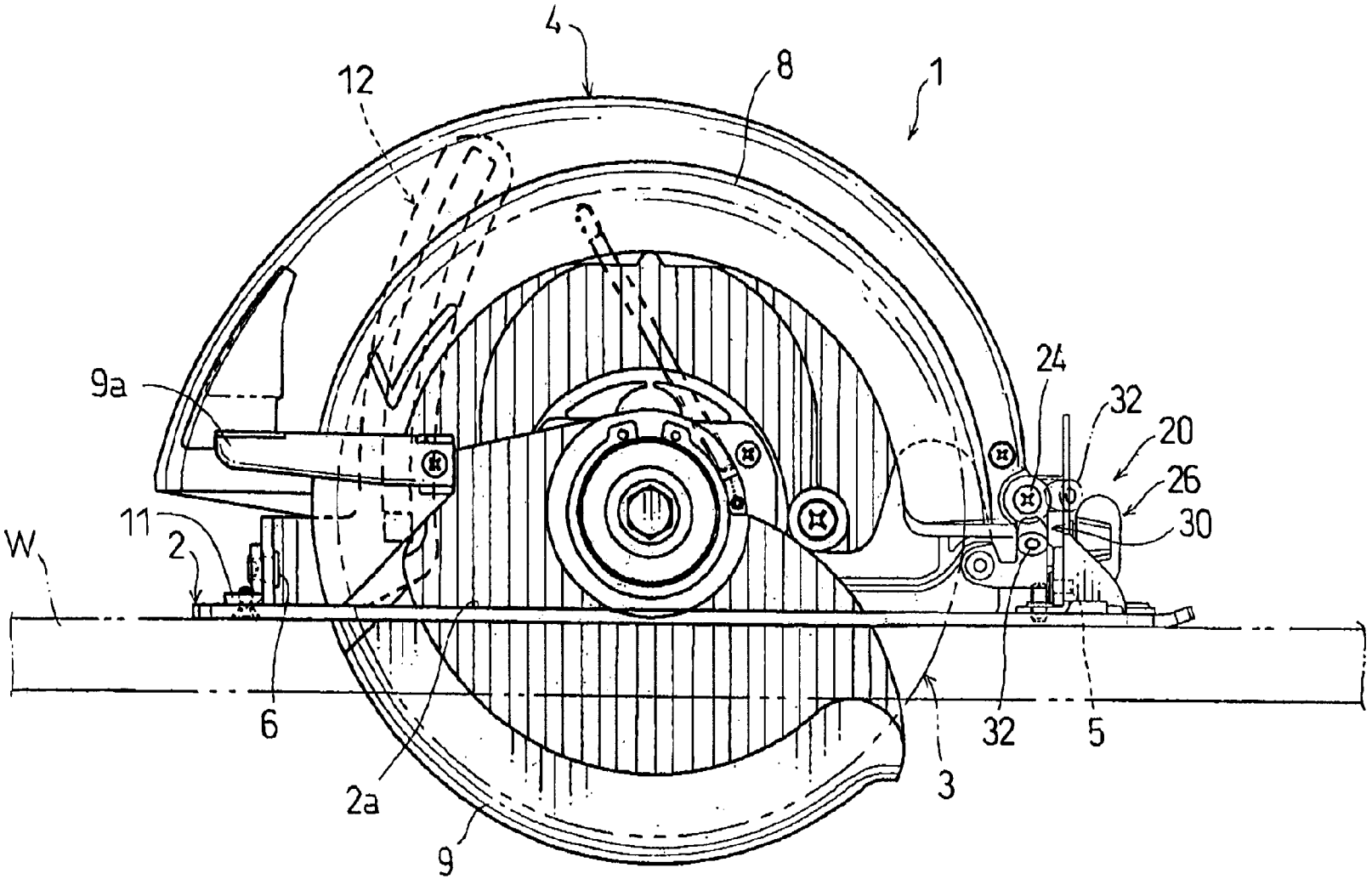
FIG. 1 is a left side view of a first representative circular saw having an improved laterally inclining device.

Portable circular saws may have, for example, a base and a saw unit. The base may be adapted to contact a workpiece during a cutting operation. The saw unit may include a circular saw blade and the saw unit may be pivotally coupled to the base, so that the saw unit can laterally incline relative to the base. Bevel cuts may be performed with the saw unit in a laterally inclined position. A tightening device may be provided to fix or lock the position of the saw unit relative to the base in the lateral inclining (bevel) position.

Preferably, portable circular saws are taught that are capable of selectively stopping at a certain bevel angle, depending upon whether a stopper mechanism is in an operative position or in a non-operative position. For example, the stopper mechanism may be set, e.g., to stop the saw unit in a position that forms a 45° angle between the saw blade and the base. In the operative position, the stopper mechanism stops the saw unit in the 45° position and does not permit the saw unit to move beyond the 45° position. On the other hand, in the non-operative position, the saw unit is permitted to freely move past the 45° position without interference of the stopper mechanism.

Two separate stopper mechanisms may be provided, for example, to provide a 45° position and a 0° position (vertical position). Naturally, the operator may set the preferred stopping positions and other stopping positions are envisioned by the present teachings.

In one example of the present teachings, a stopper device may be provided that is adapted to limit the maximum lateral inclining angle (e.g. 50°) of the saw unit and may include a stopper and an engaging mechanism. Preferably, the stopper can move in a fixed relationship with the saw unit. The engaging mechanism may be mounted, for example, on the base and may contact the stopper when the saw unit is in a first maximum inclined position (e.g. 45°) and when the saw unit is in a second maximum inclined position (e.g. 50°) that is a larger inclined angle than the first inclined position.

Therefore, the operator can easily change the maximum inclined position from the first maximum inclined position to the second maximum inclined position by the operation of the engaging mechanism. In that case, the engaging mechanism will not engage the stopper at the first maximum inclined position.

As a result, the operator can smoothly incline the saw unit from an inclined position that is less than the first maximum inclined position, such as 45°, to the second maximum inclined position, such as 50°, via the first maximum inclined position without interruption of the inclining movement at the first maximum inclined position.

In another aspect of the present teachings, the portable circular saw may include a first stopper adapted to move with the base. A second stopper may also be provided that is adapted to laterally pivot in a fixed relationship with the saw unit. The first stopper and the second stopper may be constructed and arranged to contact each other to stop the saw unit at a first inclining angle defined between the saw unit and the base when at least one of the first stopper or second stopper is an operative position. On the other hand, if at least one of the first stopper or the second stopper is in a non-operative position, the first stopper and second stopper will not contact each other at the first inclining angle. Thus, the saw unit may pivot to a second inclining angle, which past the first inclining angle, when the first stopper or second stopper has been moved to the non-operative position.

One of the first stopper and the second stopper may be, for example, adapted to shift between a first position, in which the first and second stopper contact each other, and a second position in which the first and second stopper will not contact each other when the saw unit is in the first inclining angle.

The circular saw may also include a joint plate that is adapted to laterally pivot relative to the base and to vertically pivotally support the saw unit. The second stopper may be mounted on the joint plate. A guide plate may be fixedly mounted on the base and the guide plate may have a guide slot. In this case, the joint plate may be laterally pivotally mounted on the guide plate. The terminal ends of the guide slot may define a maximum pivotal range of the saw unit with respect to the base.

Means for adjusting the first pivot angle and/or the second pivot angle also may be provided in circular saws according to the present teachings. The adjusting means may, for example, include an adjusting screw that serves as one of the first stopper or the second stopper. Further, the second stopper may comprise a stopper member that is mounted on the joint plate.

In another aspect of the present teachings, the stopper may be defined in part by an upper surface of the base.

In another aspect of the present teachings, a pivot shaft may be provided and the saw unit may vertically pivot about the pivot shaft with respect to the joint plate. A second stopper may be provided and may include a stopper member that is mounted on the pivot shaft. The stopper member may be adapted to pivot about the pivot shaft between the first and second pivot angles.

In another aspect of the present teachings, the first stopper may include a stopper member that is adapted to shift along the base between the first and the second positions.

In another aspect of the present teachings, circular saws may include a large-angle stopper mechanism that is adapted to define an inclining or bevel angle of the saw unit. In this case, the saw unit may be adapted to selectively stop either at a first maximum angle and a second maximum angle. For example, the first maximum angle may be 45° and the second maximum angle may be 50°. If the large-angle stopper mechanism is engaged, the saw unit will stop at the 45° position. However, if the large-angle stopper mechanism is not engaged, the saw unit can freely pass through the 45° position to the 50° position without stopping.

In another aspect of the present teachings, circular saws may include a small-angle stopper mechanism that is adapted to define an inclining angle of the saw unit. In this case, the saw unit may be adapted to selectively stop either at a first minimum angle and a second minimum angle. For example, the first minimum angle may be −5° and the second minimum angle may be 0°. If the small-angle stopper mechanism is engaged, the saw unit will stop at the 0° position. However, if the small-angle stopper mechanism is not engaged, the saw unit can freely pass through the 0° position to the −5° position without stopping.

Circular saws may include either the small angle stopper mechanism or the large angle stopper mechanism. Naturally, circular saws may include both the small angle stopper mechanism and the large angle stopper mechanism.

Either one or both of the large-angle and small-angle stopper mechanisms may include, for example, a first stopper adapted to move with the base. A second stopper that is adapted to laterally pivot with the saw unit may also be provided. The large-angle stopper and the second stopper may be adapted to contact each other when the saw unit is in a first maximum angle (e.g. 45°). However, if one of the second stopper or the large angle stopper mechanism is in a non-operative position, the second stopper and the large angle stopper mechanism will not contact each other when the saw unit is in the first maximum angle. In this case, the saw unit is adapted to pivot to a second maximum angle that is larger than the first maximum angle.

Each of the additional features and method steps disclosed above and below may be utilized separately or in conjunction with other features and method steps to provide improved circular saws and methods for designing and using such circular saws. Representative examples of the present invention, which examples utilize many of these additional features and method steps in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention. Moreover, various features of the representative examples may be combined in ways that are not specifically enumerated in order to provide additional useful embodiments of the present teachings.

Figure 2:
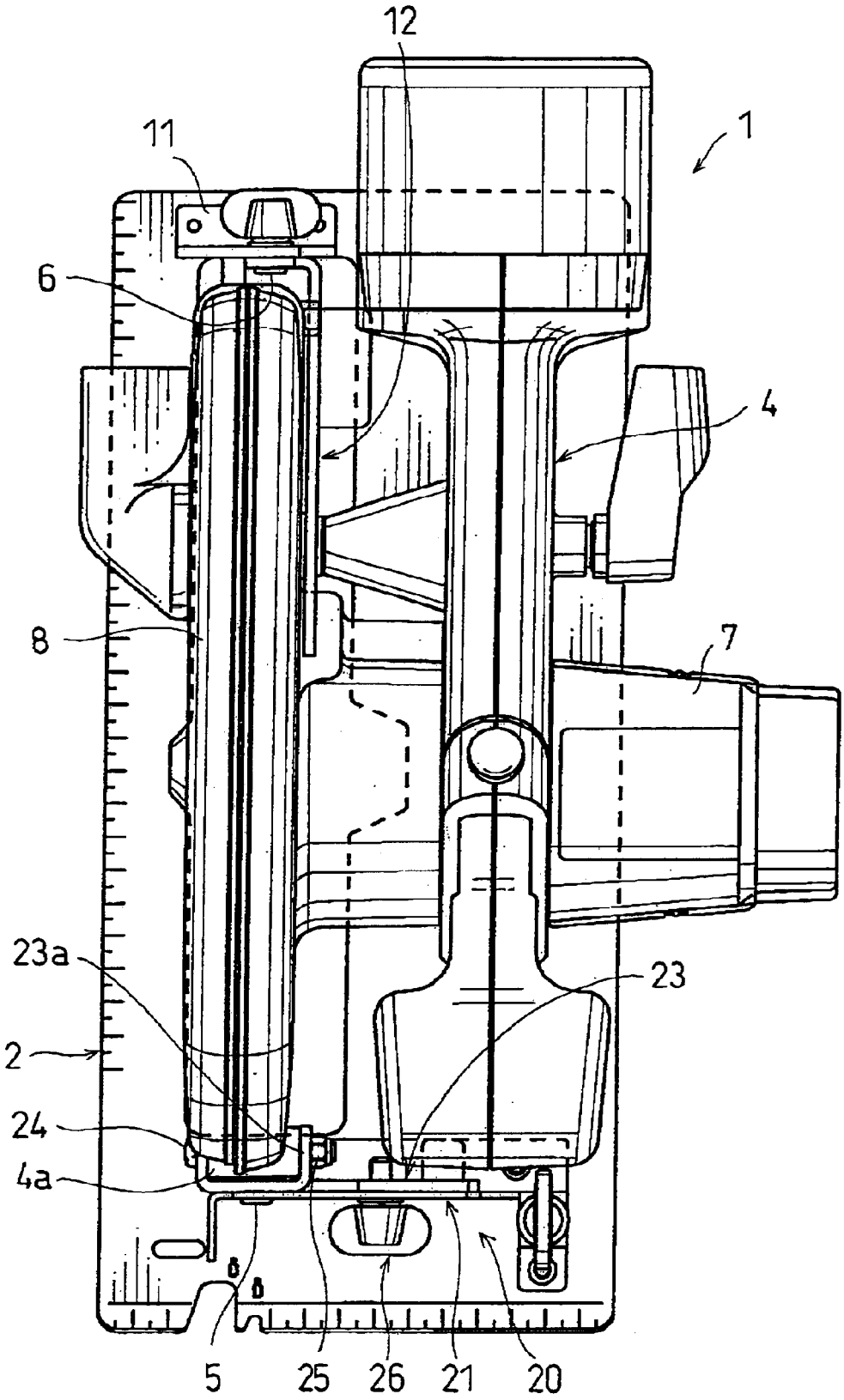
FIG. 2 is a plan view of the first representative circular saw.

A first representative embodiment of a portable circular saw will now be described with reference to FIGS. 1 to 11. FIGS. 1 and 2 illustrate a portable circular saw 1 in a left side view and a plan view, respectively.

The circular saw 1 may comprise a base 2 and a saw unit 4. The base 2 is preferably adapted to be placed on a workpiece W during a cutting operation (see FIG. 1). The saw unit 4 may have a rotary circular saw blade 3 and an electric motor 7 (FIG. 2) for driving the saw blade 3.

A laterally inclining device 20 may comprise pivotal supports 5, 6 that are disposed on the base 2 on the front side and the rear side (right side and loft side as viewed in FIG. 1) of the saw unit 4, respectively, so that the saw unit 4 can laterally pivot to and from a 0° position, as shown in FIGS. 1 and 2.

Figure 3:
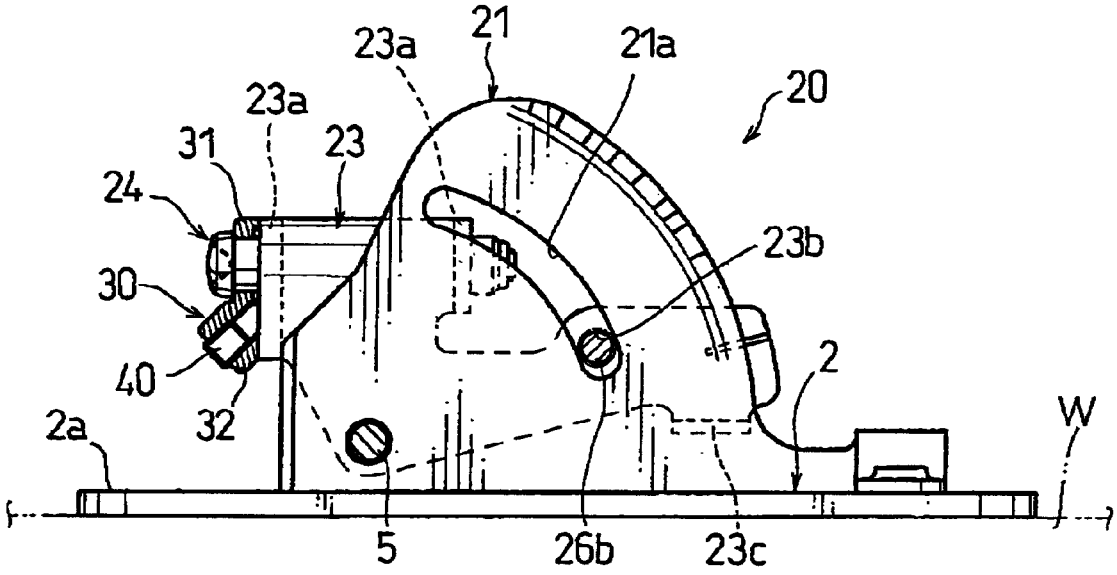
FIG. 3 is a broken away front view of a laterally inclining device of the first representative circular saw.

When the saw unit 4 is in the 0° position, the saw blade 3 may extend substantially perpendicularly with respect to an upper surface 2*a* of the base 2 or the workpiece W (see FIG. 3). In a normal (straight) cutting operation, the circular saw 1 is moved rightward relative to the workpiece W, as viewed in FIG. 1. On the other hand, when the saw unit 4 is in a laterally inclined position from the 0° position, a bevel cutting operation of the workpiece W can be performed.

The saw unit 4 may have a blade case 8 that substantially covers an upper half of the saw blade 3. A safety cover 9 may serve to cover the exposed lower half of the saw blade 3 and can move to uncover the saw blade 3 during the cutting operation, which may be performed by moving the circular saw 1 rightward as viewed in FIG. 1. Thus, the safety cover 9 can rotate relative to the saw unit 4 about a pivotal axis that may coincide with the rotational axis of the saw blade 3. Further, the lower half of the saw blade 3 can be exposed to the outside when the safety cover 9 rotates in a clockwise direction as viewed in FIG. 1. A lever 9*a* may be attached to the safety cover 9 to permit the operator to manually open and close the safety cover 9.

Figure 4:
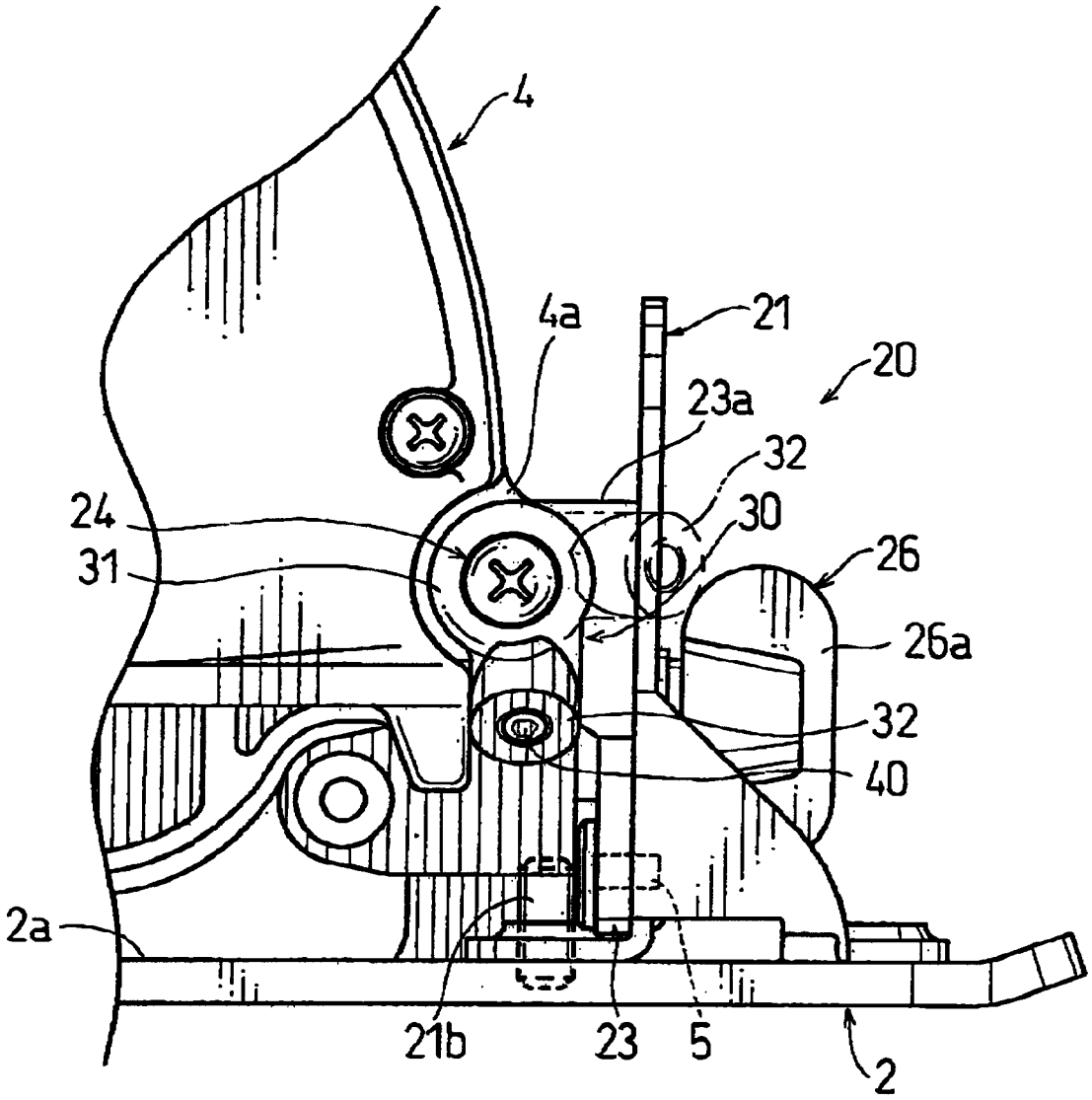
FIG. 4 is a left side view of the laterally inclining device.
Figure 5:
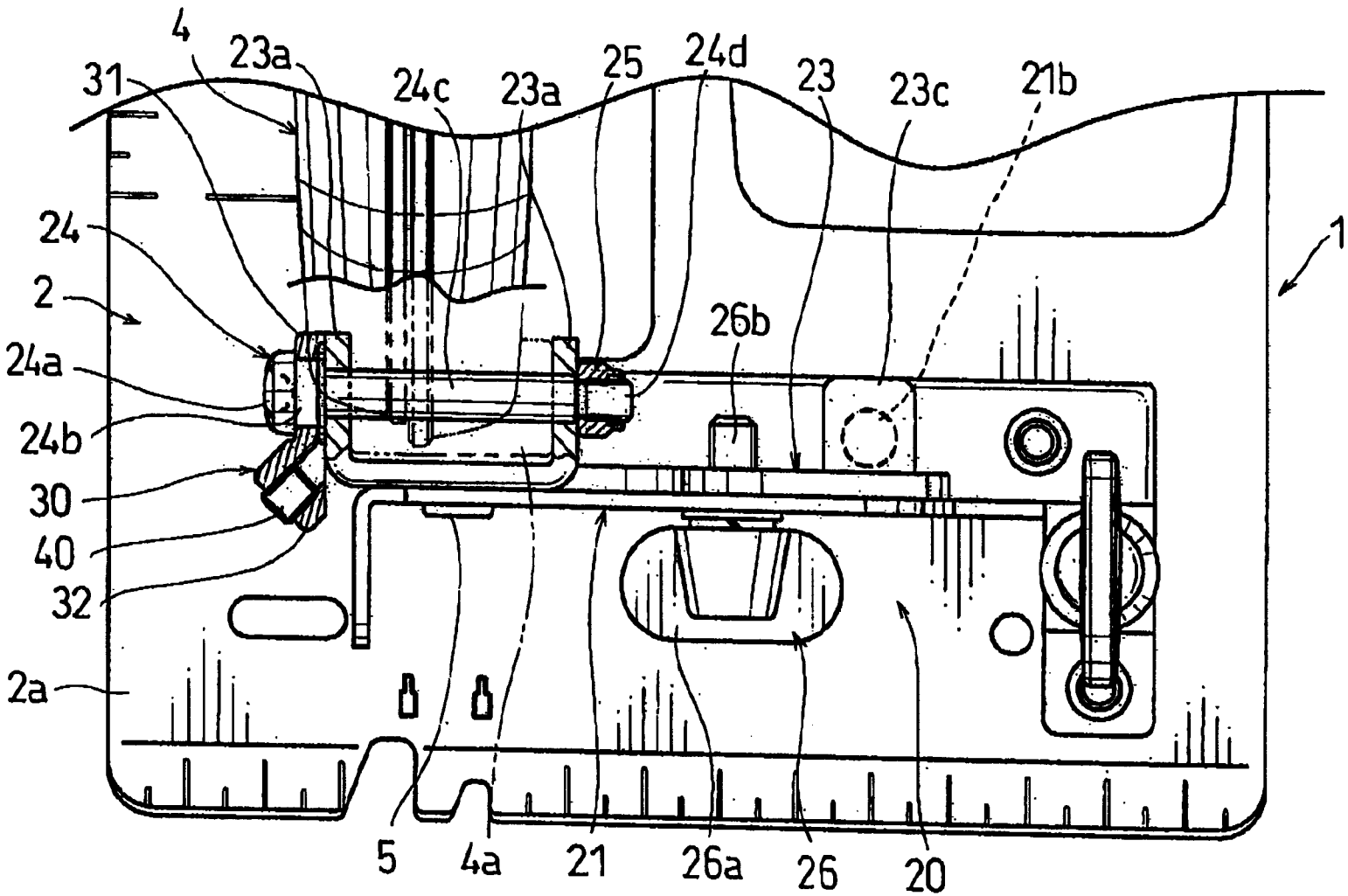
FIG. 5 is a broken away plan view of the laterally inclining device.

The laterally inclining device 20 may be disposed adjacent to the front pivotal support 5 as shown in FIG. 1. FIGS. 3 to 5 show the representative laterally inclining device 20 in a front view with a part in section, a left side view and a plan view with a part in section, respectively. The laterally inclining device 20 may include an upright guide plate 21 that is secured to an upper surface 2*a* of the base 2. The front pivotal support 5 may comprise a support pin that is mounted on the guide plate 21. As shown in FIG. 3, an elongated guide slot 21*a* may be formed in the guide plate 21 and may have an arc-shaped configuration with respect to the pivotal support 5 (and the pivotal support 6) that is a lateral pivotal axis of the saw unit 4. The guide slot 21*a* may have a substantially uniform width in the lengthwise direction.

As shown in FIG. 5, a joint plate 23 may be disposed on the rear side (upper side as viewed in FIG. 5) of the guide plate 21 and may be vertically pivotally mounted on the pivotal support 5. A pair of parallel support lugs 23*a* may be formed integrally with an upper end of the left side portion of the joint plate 23 and may extend substantially perpendicularly to the rear surface of the joint plate 23. When the saw unit 4 is in the 0° position as shown in FIGS. 3 to 5, the support lugs 23*a* may extend substantially perpendicularly to the upper surface 2*a* of the base 2.

As shown in FIG. 5, the saw unit 4 may have a boss portion 4*a* that is formed on the front end of the blade case 8. The boss portion 4*a* may be fitted between the support lugs 23*a* and may be pivotally supported by the support lugs 23*a* by means of a bolt 24 and a nut 25. More specifically, as shown in FIG. 5, the bolt 24 may have a head 24*a* with a cross-shaped recess, and a large-diameter shaft portion 24*b*, an elongated small-diameter shaft portion 24*c*, and a threaded shaft portion 24*d* that are formed integrally with each other and are arranged in this sequence on the same axis. The threaded shaft portion 24*d* may have a diameter that is slightly smaller than the diameter of the small diameter shaft portion 24*c*. The bolt 24 may be inserted into the left side support lug 23*a* (as viewed in FIG. 5), the boss portion 4*a* and the right side support lug 23*a* in this sequence through the corresponding insertion holes that are formed in these parts, until the large-diameter shaft portion 24*b* contacts the left side support lug 23*a*. The nut 25 may then be engaged with the threaded shaft portion until the nut 25 contacts the right side support lug 23*a*. In this case, the small-diameter shaft portion 24*c* of the bolt 24 may be slidably inserted into the insertion holes of the support lugs 23*a* and the boss portion 4*a*, so that the boss portion 4*a* can pivot relative to the joint plate 23 about the bolt 24. Because the nut 25 cannot be tightened further after it contacts the right side support lug 23*a*, the nut 25 is prevented from excessive tightening. A stopper member 30 may be mounted on the large-diameter shaft portion 24*b*.

Therefore, the saw unit 4 can vertically pivot relative to the base 2 about the bolt 24. More specifically, the saw unit 4 can pivot upwardly from a lowermost position shown in FIG. 1 and can pivot to return to the lowermost position. As the vertical position of the saw unit 4 changes, the amount that the saw blade 3 downward protrudes from the base 2 will change. Thus, the cutting depth of the saw blade 3 into the workpiece W may vary.

Referring to FIG. 1, the rear side pivotal support 6 may be mounted on an angle plate 11 that is secured to the upper surface 2*a* of the rear portion of the base 2. The angle plate 11 may laterally pivotally support a depth guide 12 that vertically slidably supports the rear portion of the blade case 8 of the saw unit 4. Thus, as the saw unit 4 pivots vertically about the bolt 24 to change the cutting depth of the saw blade 3, the blade case 8 may slide along the depth guide 12. The vertical position of the blade case 8 relative to the depth guide 12 can be locked and unlocked by means of a lock screw (not shown).

As shown in FIG. 5, the representative laterally inclining device 20 may further include a lock screw 26 that can lock and unlock the pivotal position of the joint plate 23 relative to the guide plate 21. The lock screw 26 may have a tab 26*a* and a threaded shank 26*b*. As shown in FIG. 3, the threaded shank 26*b* may be inserted into the guide slot 21*a* formed in the guide plate 21 and may engage a threaded hole 23*b* formed in the joint plate 23. Therefore, as the saw unit 4 laterally pivots about the pivotal supports 5 and 6 with the lock screw 26 loosened (i.e., without removing the lock screw 26 from threaded hole 23*b*), the threaded shank 26*b* may move along the guide slot 21*a*. Preferably, the length and the position of the guide slot 21*a* is determined such that the threaded shank 26*b* contacts one end of the guide slot 21*a* when the saw unit 4 or the joint plate 23 has pivoted over the 0° position or the vertical position by a small distance in the clockwise direction as viewed in FIG. 3. On the other hand, the threaded shank 26*b* may contact the other end of the guide slot 21*a* when the saw unit 4 is in a 50° position (hereinafter also called "a maximum pivoted position"), in which the saw unit 4 has pivoted by an angle of 50° from the 0° position in the counterclockwise direction as viewed in FIG. 3. Thus, the guide slot 21*a* limits the pivotable range of the saw unit 4 between substantially the 0° position and the 50° position.

FIGS. 3 to 5 show the laterally inclining device 20 when the saw unit 4 is in the 0° position. In order to accurately set the 0° position of the saw unit 4, the laterally inclining device 20 may include a small-angle side stopper mechanism, which small-angle side stopper mechanism may include a stopper member 23*c* and a stopper screw 21*b*. As shown in FIG. 5, the stopper member 23*c* may be formed on the rear side of the right end of the joint plate 23. As shown in FIG. 4, the stopper screw 21*b* may engage a horizontal base portion of the angular plate 21 and may extend in the vertical direction, so that the upper end of the stopper screw 21*b* vertically opposes the stopper member 23*c*. Thus, the first stopper member 23*c* can abut the upper end of the stopper screw 21*b* when the saw unit 4 is in the 0° position. Fine adjustment of the 0° position can be performed by rotating the stopper screw 21*b* using an appropriate tool (not shown) so as to change the level of the upper end of the stopper screw 21*b*.

In order to set a 45° position or a reference pivoted position of the saw unit 4, the laterally inclining device 20 may further include a large-angle side stopper mechanism. The saw unit 4 in the reference position is inclined by an angle of 45° relative to that in the 0° position. As shown in FIGS. 3 to 5, the stopper member 30 may be mounted on the saw unit 4 by means of the bolt 24 that vertically pivotally supports the boss portion 4*a* of the saw unit 4 on the support lugs 23*a* or the joint plate 23.

Figure 9:
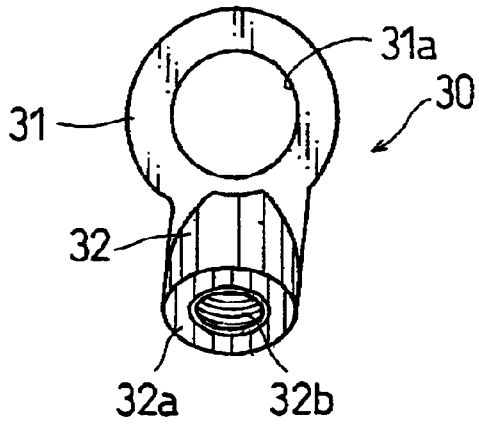
FIG. 9 is a front view of the stopper member.
Figure 10:
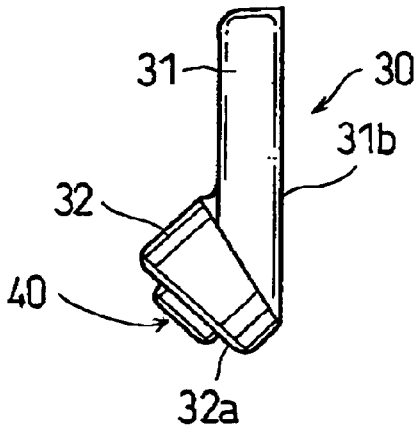
FIG. 10 is a right side view of the stopper member.

The stopper member 30 will be described in detail with reference to FIGS. 9, 10 and 11, which show the stopper member 30 in a front view, a right side view and a broken away right side view, respectively. The stopper member 30 may include a base portion 31 and an extension 32 that extends from one side of the base portion 31. The base portion 31 may have a substantially annular configuration with a bolt insertion hole 31*a*. The extension 32 may have a substantially tubular configuration and may have a central axis, which central axis extends in a radial direction of the base portion 31 but is inclined relative to the central axis of the bolt insertion hole 31*a*.

Figure 11:
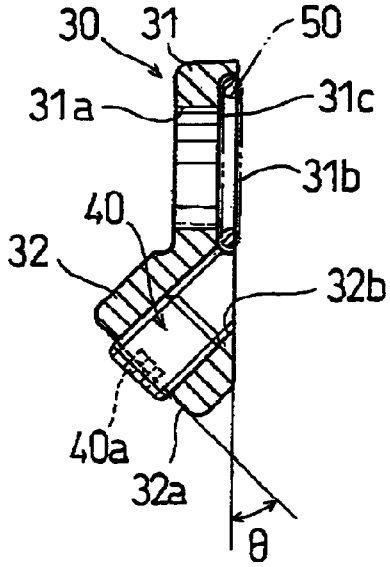
FIG. 11 is a right side sectional view of the stopper member.

As shown in FIG. 11, an annular recess 31*c* may be formed in a rear surface 31*b* of the base portion 31 about the bolt insertion hole 31*a*. An end surface 32*a* of the extension 32 may be inclined by an angle of θ relative to the rear surface 31*b* of the base portion 31. Preferably, θ is determined to be 45°. A threaded hole 32*b* may be formed in the extension 32 and may have a central axis that extends perpendicularly to the end surface 32*a*.

An adjusting screw 40 may be inserted into the threaded hole 32*b* from the side of the end surface 32*a* and may engage the threaded hole 32*b*, so that one end of the adjusting screw 40 partly extends from the end surface 32*a* outward of the threaded hole 32*b*. A hexagonal recess 40*a* may be formed in the end surface of the adjusting screw 40, so that the adjusting screw 40 can be rotated by an appropriate tool (not shown) that engages the hexagonal recess 40*a*. FIG. 9 shows the stopper member 30 with the adjusting screw 40 removed.

The end surface of the adjusting screw 40 may be adapted to contact the upper surface 2*a* of the base 2 in surface-to-surface relationship therewith so as to determine the 45° position of the saw unit 4. In order to make a fine adjustment of the 45° position, the operator can rotate the adjusting screw 40 to change the protruding distance of the one end of the adjusting screw 40 from the end surface 32*a* of the extension 32.

The mounting structure of the stopper member 30 on the bolt 24 will now be explained. First, an O-ring 50 that is preferably made of resilient, elastic material may be fitted within the annular recess 31*c* (see FIG. 11) prior to the insertion of the bolt 24 into the corresponding insertion holes formed in the support lugs 23*a* and the boss portion 4*a*. Then, the bolt 24 may be inserted into the bolt insertion hole 31*a* from the left side of the base portion 31 of the stopper member 30, as viewed in FIG. 5. The bolt 24 may subsequently be inserted into the insertion holes formed in the left side lug 23*a* of the joint plate 23, the boss portion 4*a* and the right side lug 23*a*, until the large-diameter shaft portion 24*b* contacts the left side lug 23*a*. Finally, the nut 25 may be engaged with the bolt 24 and may be tightened.

As a result, the base portion 31 of the stopper member 30 can be rotatably supported by the large-diameter shaft portion 24*b* of the bolt 24 and can be held between the head 24*a* and the left side support lug 23*a*.

In addition, the O-ring 50 may provide an appropriate frictional force between the base portion 31 of the stopper member 30 and the left side lug 23*a* of the joint plate 23, so that the stopper member 30 can be held in any desired rotational position relative to the bolt 24 against the weight of the stopper member 30. Thus, the stopper member 30 can be held either in an operative position as indicated by solid lines in FIG. 4 or in non-operative position as indicated by chain lines. In the operative position, the extension 32 is oriented downwardly toward the base 2. In the non-operative position, the extension 32 is oriented forwardly, so that the end surface of the adjusting screw 40 may not contact the upper surface 2*a* of the base 2 even when the saw unit 4 has pivoted to the 45° position.

According to the first representative circular saw 1, the lateral pivot position of the joint plate 23 about the pivotal supports 5 and 6 may be fixed by tightening the lock screw 26, so that the saw unit 4 can be fixed in any of the pivoted positions within the movable range of the lock screw 26 along the arc-shaped guide slot 21*a* formed in the guide plate 21. In order to perform the cutting operation of the workpiece W, the operator fixes the saw unit 4 in a desired laterally pivoted position, and then places the base 2 on the workpiece W. Thereafter, he or she starts the motor 7 and moves the circular saw 1 along the workpiece W, so that the workpiece W can be cut by the saw blade 3.

In order to change the lateral pivot position of the saw unit 4, the operator loosens the lock screw 26, so that the joint plate 23 or the saw unit 4 become free to pivot laterally about the pivotal supports 5 and 6 relative to the guide plate 21 or the base 2. Therefore, the operator can pivot the saw unit 4 to a different pivoted position, while the threaded shank 26*b* of the lock screw 26 moves along the guide slot 21*a* (see FIG. 3). When the saw unit 4 has reached the desired different pivoted position, the operator tightens the lock screw 26, so that the saw unit 4 can be fixed in the desired pivoted position.

According to the first representative embodiment of the circular saw 1, the laterally pivoted position of the saw unit 4 can be reliably and rapidly changed from the 0° position to either the 45° position or the 50° position.

Figure 6:
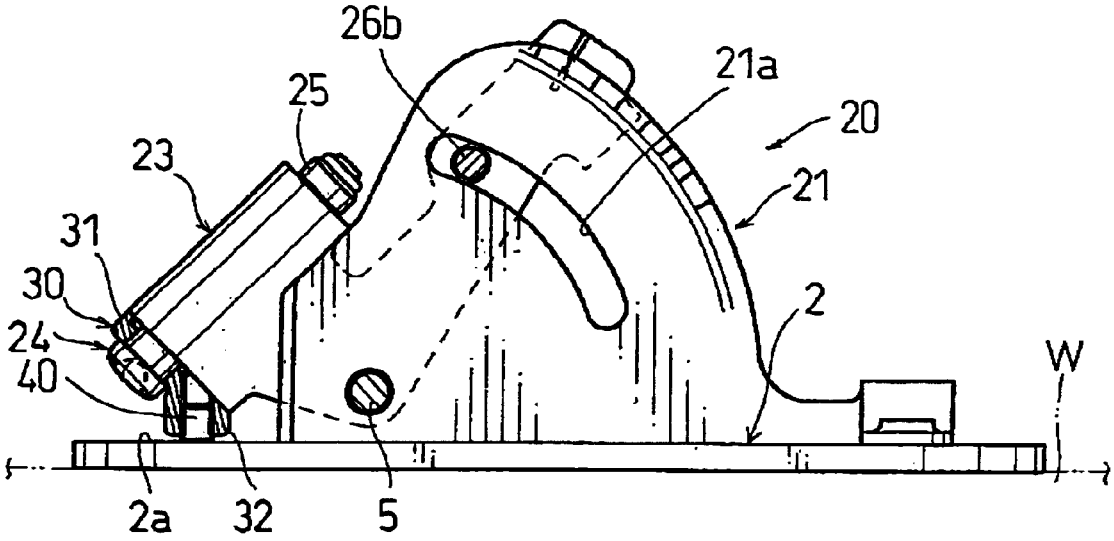
FIG. 6 is a broken away, front view of the laterally inclining device when the saw unit is in a reference pivoted position.

Thus, in order to change bevel angle of the saw unit 4 from the 0° position to the 45° position, the operator sets the stopper member 30 to the operative position, in which the extension 32 is oriented downwardly toward the base 2 as shown in FIG. 3. Then, he or she loosens the lock screw 26 and pivots the saw unit 4 from the 0° position, so that the joint plate 23 pivots about the pivotal support 5 in the counterclockwise direction as viewed in FIG. 3. When the one end of the adjusting screw 40 contacts the upper surface 2*b* of the base 2 as shown in FIG. 6, the pivotal movement of the saw unit 4 can be stopped when the saw unit reaches the 45° position. Then, the operator tightens the lock screw 26, so that the saw unit 4 can be fixed in the 45° position or the reference pivoted position. Therefore, the operator can perform a bevel cutting operation of the workpiece W with the saw unit 4 or the saw blade 3 inclined relative to the workpiece W by an angle of 45°.

Figure 7:
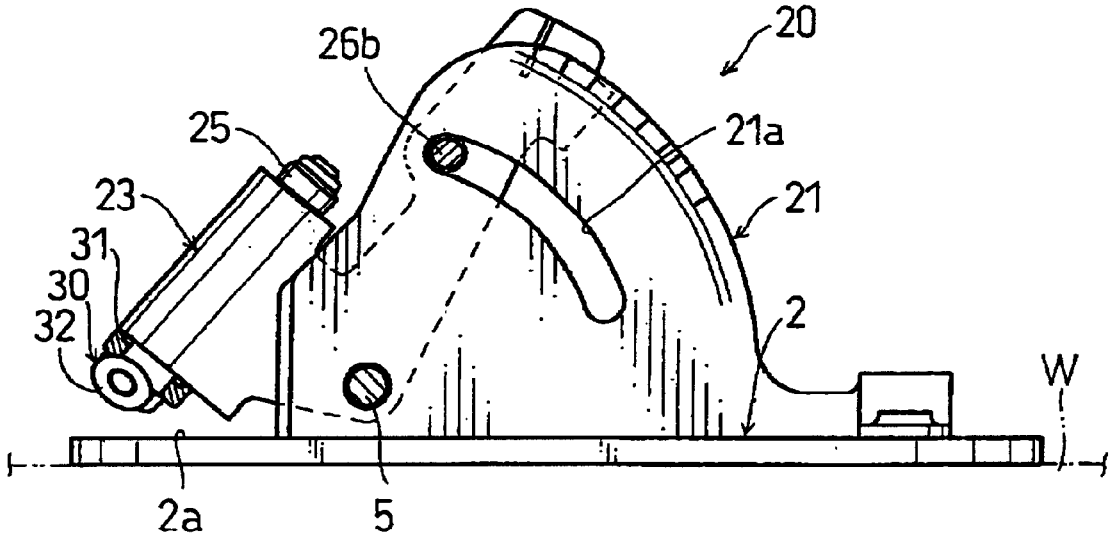
FIG. 7 is a view similar to FIG. 6, but showing the laterally inclining device when the saw unit is in an extra inclined position.
Figure 8:
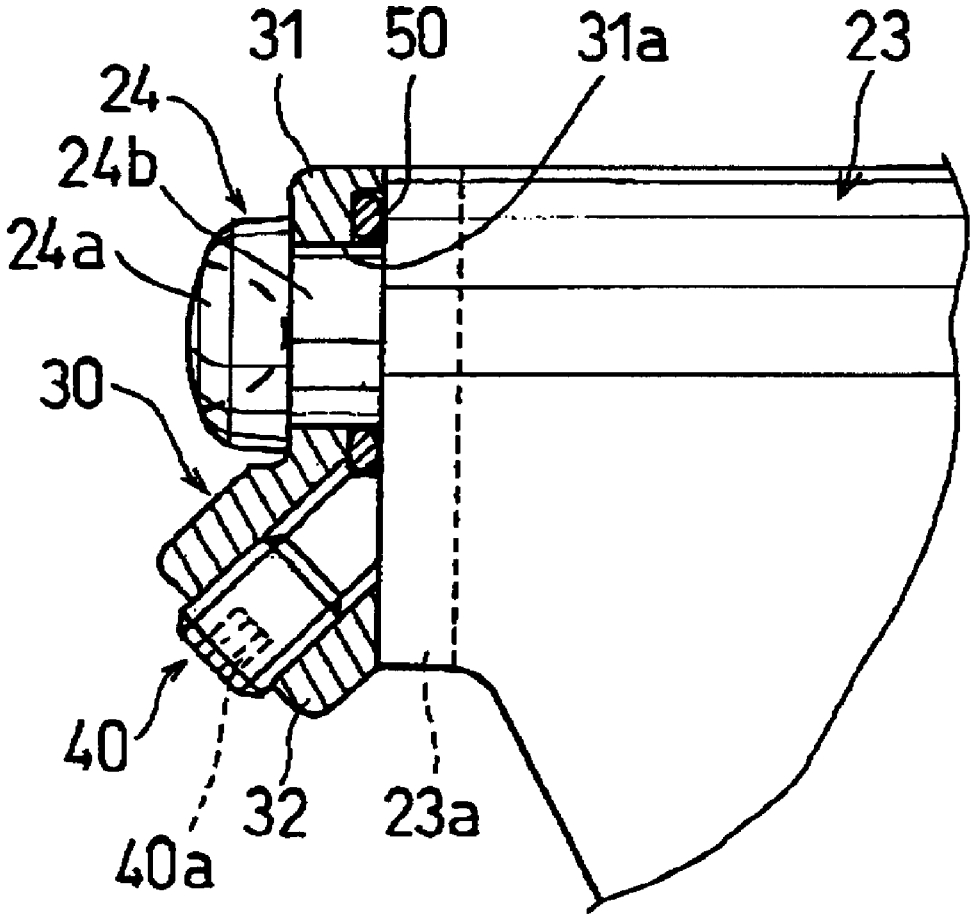
FIG. 8 is a view of a part of a joint plate with a cross-sectional view of a large-angle side stopper member.

In order to change the saw unit 4 from the 0° position to the 50° position, the operator sets the stopper member 30 to the non-operative position, in which the extension 32 is oriented forwardly as indicated by chain lines in FIG. 4. Then, he or she pivots the saw unit 4 from the 0° position, so that the joint plate 23 pivots about the pivot shaft 5 in the counterclockwise direction as viewed in FIG. 3 past the 45° pivoted position. When the threaded shank 26*b* of the lock screw 26 contacts the upper end of the guide slot 21*a* of the guide plate 21 as shown in FIG. 7, the pivotal movement of the saw unit 4 can be stopped when the saw unit 4 reaches the 50° position. Then, the operator tightens the lock screw 26, so that the saw unit 4 can be fixed in the 50° position. As a result, the operator can perform a bevel cutting operation of the workpiece W with the saw unit 4 or the saw blade 3 inclined relative to the workpiece W by an angle of 50° .

In order to return the saw unit 4 from the 45° position or the 50° position to the 0° position, the operator manually pivots the stopper member 30 to the non-operative position and then loosens the lock screw 26. Thereafter, he or she pivots the saw unit 4 toward the 0° position. The pivotal movement of the saw unit 4 can be stopped when the stopper screw 21*b* of the guide plate 21 (see FIG. 4) contacts the stopper member 23*c* of the joint plate 23 (see FIG. 5). As a result, the saw unit 4 can be set to the 0° position. Then, the operator tightens the lock screw 26, so that the saw unit 4 can be fixed in the 0° position. Therefore, the operator can perform a normal cutting operation of the workpiece W with the saw unit 4 or the saw blade 3 positioned vertically relative to the workpiece W.

As described above, the saw unit 4 can be selectively set to the 45° position or to the 50° position by positioning the stopper member 30 in the operative position or the non-operative position. More specifically, when the stopper member 30 is in the non-operative position, it does not interfere with the base 2 during the movement of the saw unit 4 from the 0° position to the 50° position past the 45° position or the movement in the opposite direction.

According to the representative circular saw 1, the angular plate 21 and the joint plate 23 may not require additional slots or may not be required to have special configurations for providing the function of selectively stopping the saw unit 4 at the 45° position or the 50° position. Therefore, the guide plate 21 and the joint plate 23 may have simple constructions in comparison with known circular saws.

In addition, because the stopper member 30 is mounted on the saw unit 4 by means of the bolt 24 that serves as a vertical pivot of the saw unit 4, the number of necessary parts for mounting the stopper member 30 on the saw unit 4 can be minimized.

Further, when the stopper member 30 rotates about the bolt 24 relative to the left side lug 23*a* of the joint plate 23, the O-ring 50 may provide an appropriate frictional force between the stopper 30 and the left side lug 23*a*. Therefore, the stopper member 30 can be held in position by such frictional force after it has been rotated to the operative position or non-operative position. In addition, because of such frictional force, the set position can be reliably maintained and may not be unintentionally or accidentally displaced even if the circular saw vibrates, which may be caused by the cutting operation.

Furthermore, the 45° position or the reference pivoted position can be accurately determined by adjusting the length of the adjusting screw 40 that is driven into the extension 32 of the stopper member 30.

A second representative embodiment of a portable circular saw will now be described with reference to FIGS. 12 to 24. The circular saw of this representative embodiment is different from the circular saw of the first embodiment mainly in the configuration of the stopper member, which corresponds in function to the stopper member 30 of the large-angle stopper mechanism of laterally inclining device 20. In other respects, the construction is substantially the same as the first representative embodiment. Therefore, in the second representative embodiment, like elements are given the same reference numerals as the first representative embodiment.

Figure 12:
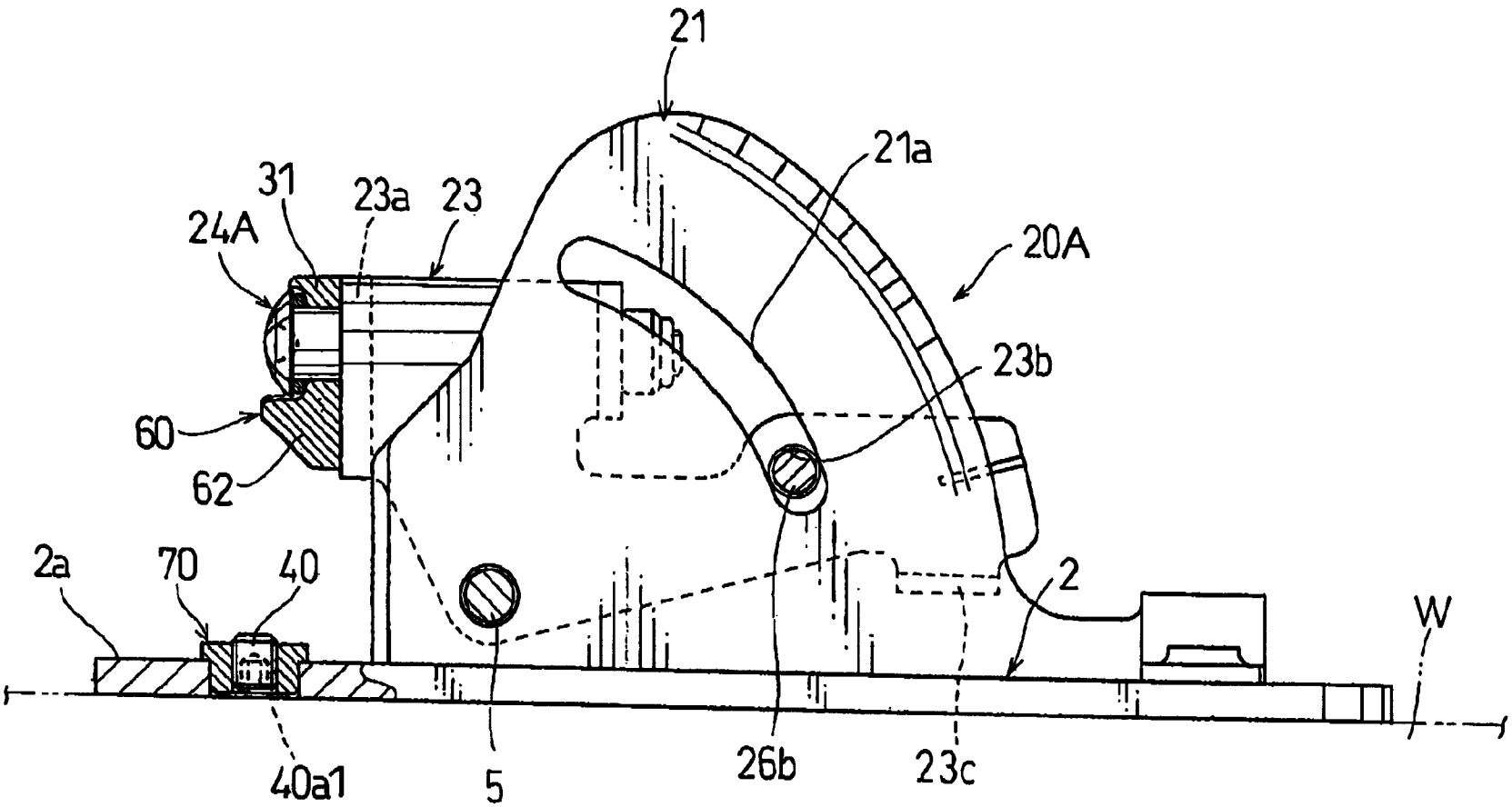
FIG. 12 is a broken away front view of a laterally inclining device of a second representative circular saw.
Figure 13:
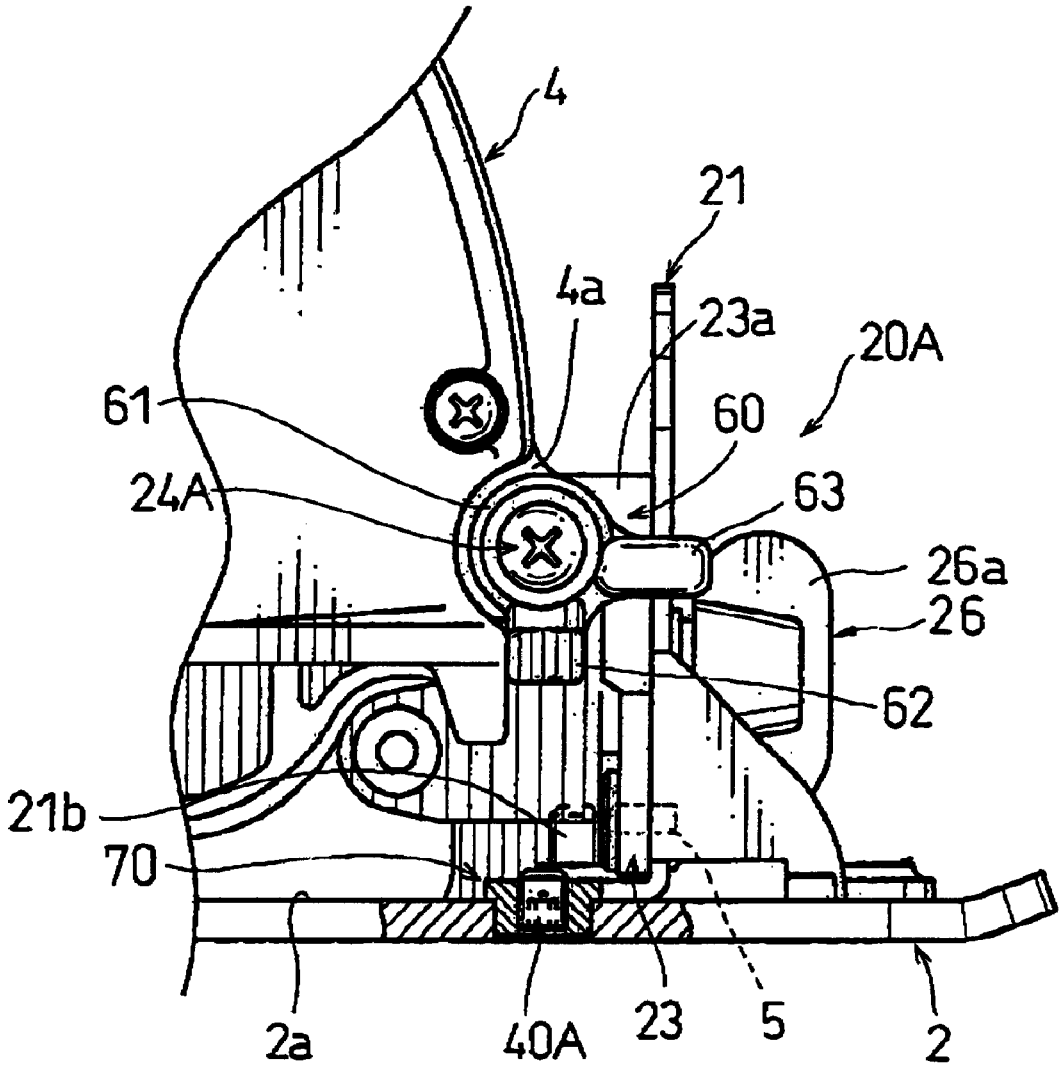
FIG. 13 is a broken away left side view of the laterally inclining device.
Figure 14:
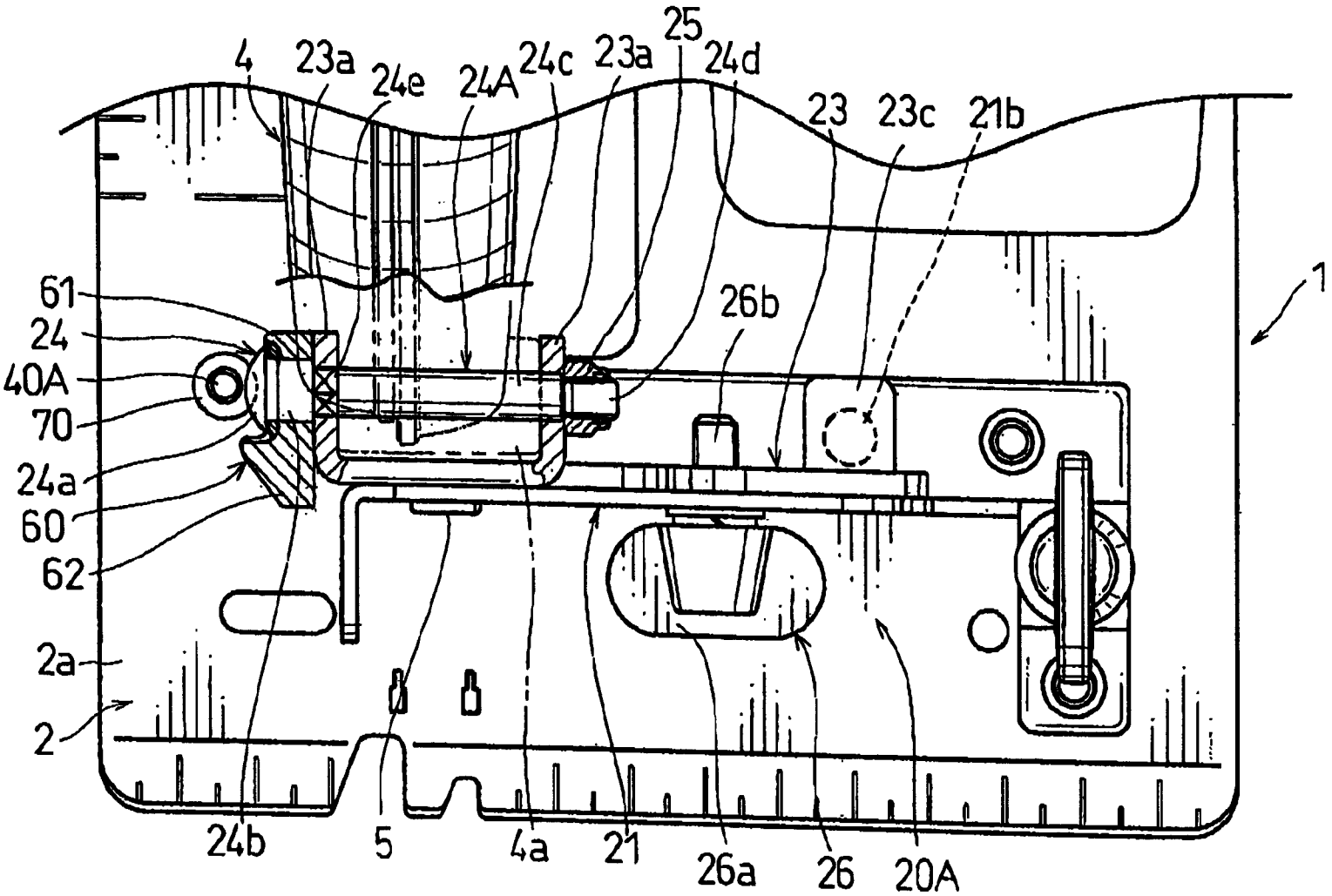
FIG. 14 is a broken away plan view of the laterally inclining device.

A laterally inclining device 20A according to the second representative embodiment of a circular saw is shown in FIGS. 12, 13 and 14 in a broken away front view, a broken away left side view and a broken away plan view, respectively. The laterally inclining device 20A comprises a large-angle side stopper mechanism and a small-angle side stopper member. The construction of the small-angle side stopper member that defines the 0° position of the saw unit 4 is the same as that of the first representative embodiment. The large-angle side stopper mechanism of this representative embodiment may include a stopper member 60 that is mounted on the saw unit 4 by means of a bolt 24A in substantially the same manner as the stopper member 30 of the first representative embodiment.

FIGS. 19, 20, 21, 22 and 23 show the stopper member 60 in a front view, a left side view, a right side view, a bottom view, and a broken away bottom view, respectively. As shown in these figures, the stopper member 60 may include a base portion 61, an extension 62 and a tab 63. The base portion 61 may have a bolt insertion hole 61*a*. The extension 62 may extend radially outward from the base portion 61 and may have a substantially trapezoidal configuration in vertical section. The tab 63 also may extend radially outward from the base portion 61 and may be displaced from the extension 62 by an angle of about 90° in the counterclockwise direction of the base portion 61 as viewed in FIG. 19. Preferably, the tab 63 has a substantially rectangular parallelepiped configuration.

Figure 23:
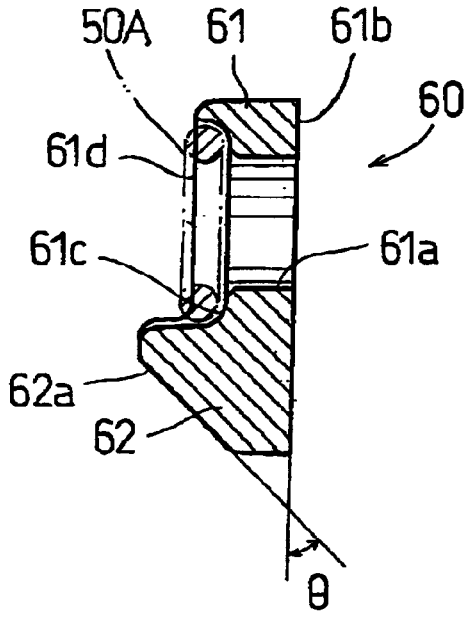
FIG. 23 is a right side sectional view of the stopper member.

As shown in FIG. 23, an annular recess 61*c* may be formed in a front surface 61*d* of the base portion 61 about the bolt insertion hole 61*a*. The extension 62 may have an inclined surface 62*a* that is inclined relative to a rear surface 61*b* of the base portion 61 by an angle of θ that may be about 45°. In this representative embodiment, an adjusting screw 40A may engage the base 2 in place of the adjusting screw 40 of the first embodiment that engages the extension 62.

The mounting structure of the stopper member 60 on the bolt 24A will now be described with reference to FIG. 18. First, an O-ring 50A may be fitted within the annular recess 61*c*, prior to the insertion of the bolt 24A into the corresponding insertion holes formed in the support lugs 23*a* and the boss portion 4*a*. Then, in the same manner as the first representative embodiment of the mounting structure, the bolt 24A may be inserted into the bolt insertion hole 61*a* from the left side (as viewed in FIG. 18) of the base portion 61 of the stopper member 60. The bolt 24A may subsequently be inserted into the insertion holes formed in the left side lug 23*a* of the joint plate 23, the boss portion 4*a* and the right side lug 23*a*, until the large-diameter shaft portion 24*b* contacts the left side lug 23*a*. Finally, the nut 25 may be engaged with the bolt 24A and may be tightened.

The bolt 24A of this representative embodiment has the same construction as the bolt 24 of the first representative embodiment, except for a square shaft part 24*e* that is formed with the small-diameter shaft portion 24*c* (see FIG. 14). The square shaft port 24*e* may be positioned within the insertion hole formed in the left side support lug 23*a* of the joint plate 23. In this connection, the insertion hole of the left side support lug 23*a* may have a square cross-section that may correspond to the configuration of the square shaft part 24*a*, so that the square shaft part 24*a* engages the insertion hole of the left side support lug 23*a* in the rotational direction of the bolt 24A. Therefore, the bolt 24A is prevented from rotating relative to the left side support lug 23*a*. In the same manner, an additional square shaft part may be formed in a position within the insertion hole of the right side support lug 23*a*, and the insertion hole may have a square configuration in section for engaging the additional square shaft part.

Figure 16:
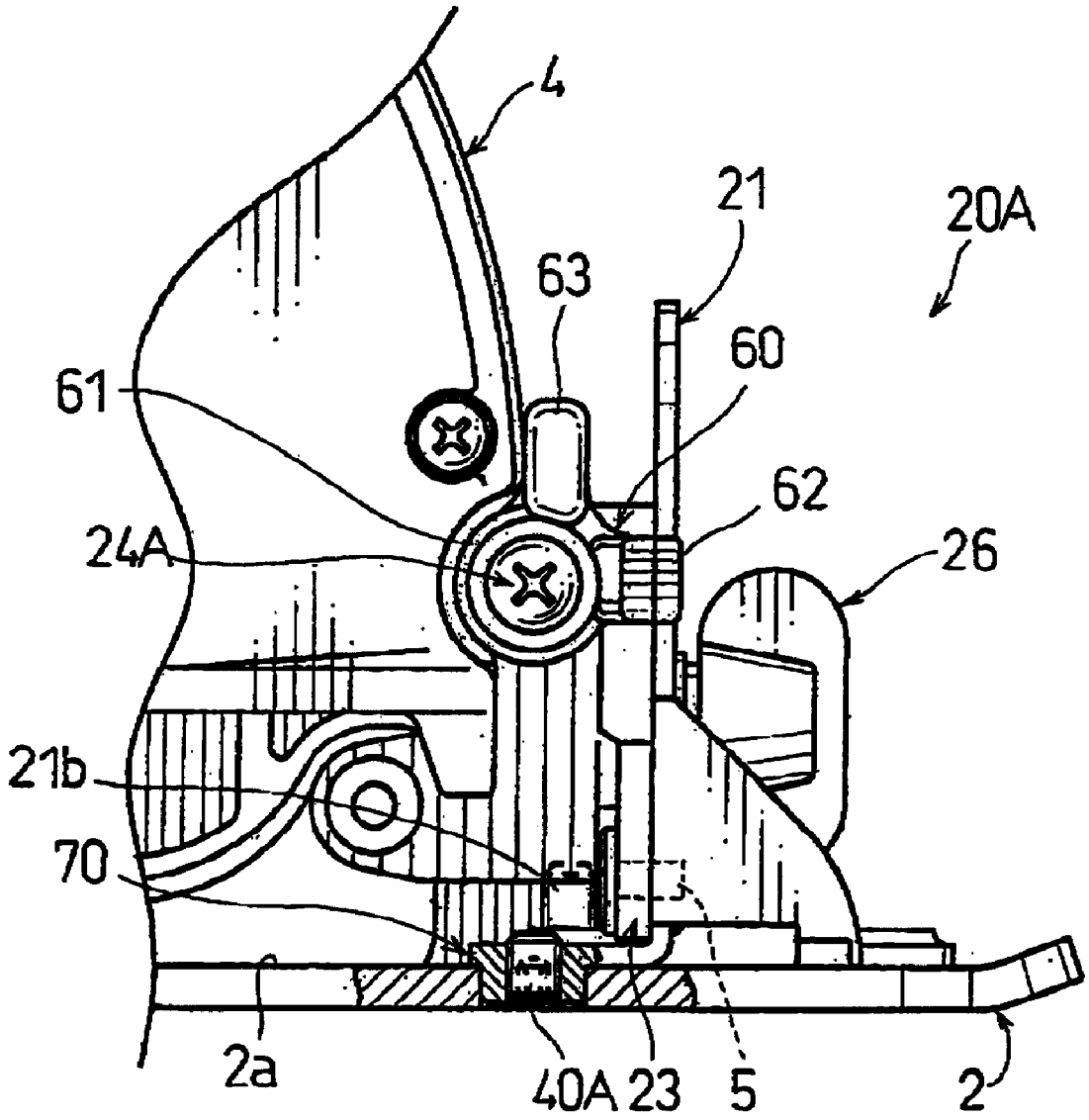
FIG. 16 is a broken away left side view when a large-angle side stopper member is in a non-operative position.

Also in this representative embodiment, the saw unit 4 can vertically pivot relative to the joint plate 23 or the base 2, and the stopper member 60 can rotate relative to the bolt 24A or the vertical pivotal axis of the saw unit 4. As shown in FIG. 18, in the mounting state of the stopper member 60, the base portion 61 of the stopper member 60 may be rotatably held between the head 24*a* of the bolt 24A and the left side support lug 23*a*. Therefore, the stopper member 60 can rotate between an operative position and a non-operative position. In the operative position, the extension 62 may be directed downward toward the base 2 as shown in FIGS. 12 and 13. In the non-operative position, the extension 62 may be directed forwardly as shown in FIGS. 14 and 16.

Figure 18:
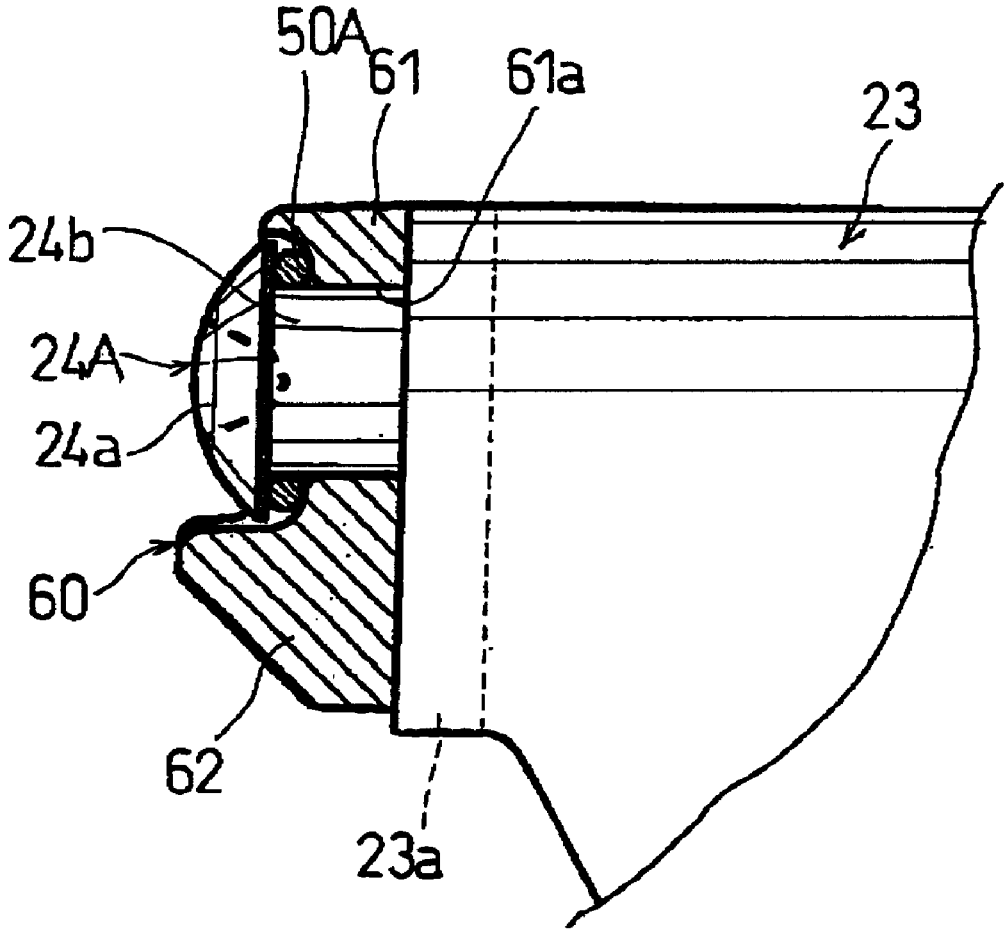
FIG. 18 is a view of a part of a joint plate with cross-sectional view of the large-angle side stopper member.
Figure 19:
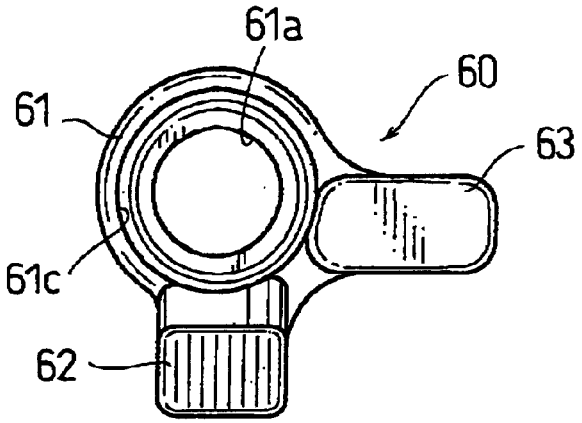
FIG. 19 is a front view of the large-angle side stopper member.
Figure 20:
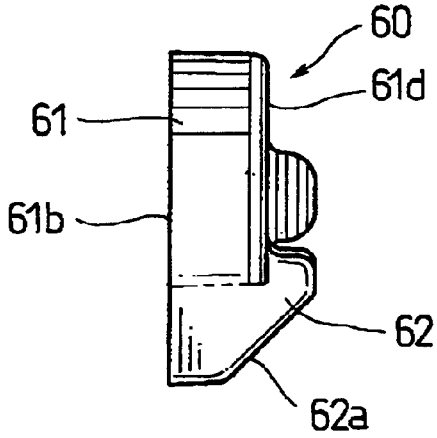
FIG. 20 is a left side view of the stopper member
Figure 21:
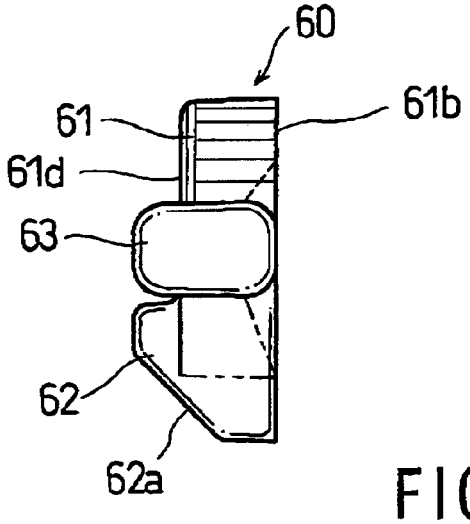
FIG. 21 is a right side view of the stopper member.
Figure 22:
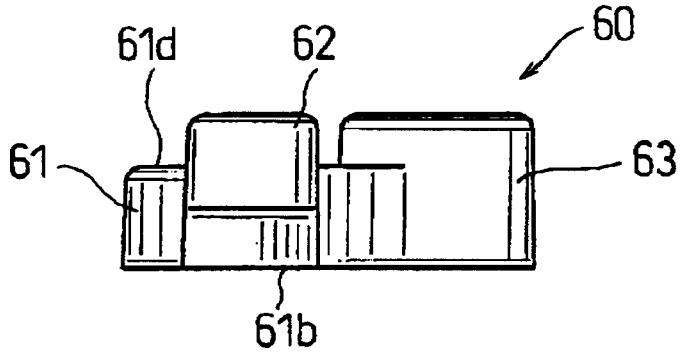
FIG. 22 is a bottom view of the stopper member.

As shown in FIG. 18, the O-ring 50A that is fitted into the recess 61*c* of the stopper member 60 may be resiliently compressed between the head 24*a* of the bolt 24 and the bottom of the recess 61*c* so as to provide an appropriate frictional force against the rotation of the stopper member 60. As a result, the stopper member 60 can be reliably held in the desired rotational position between the operative position and the non-operative position.

Figure 15:
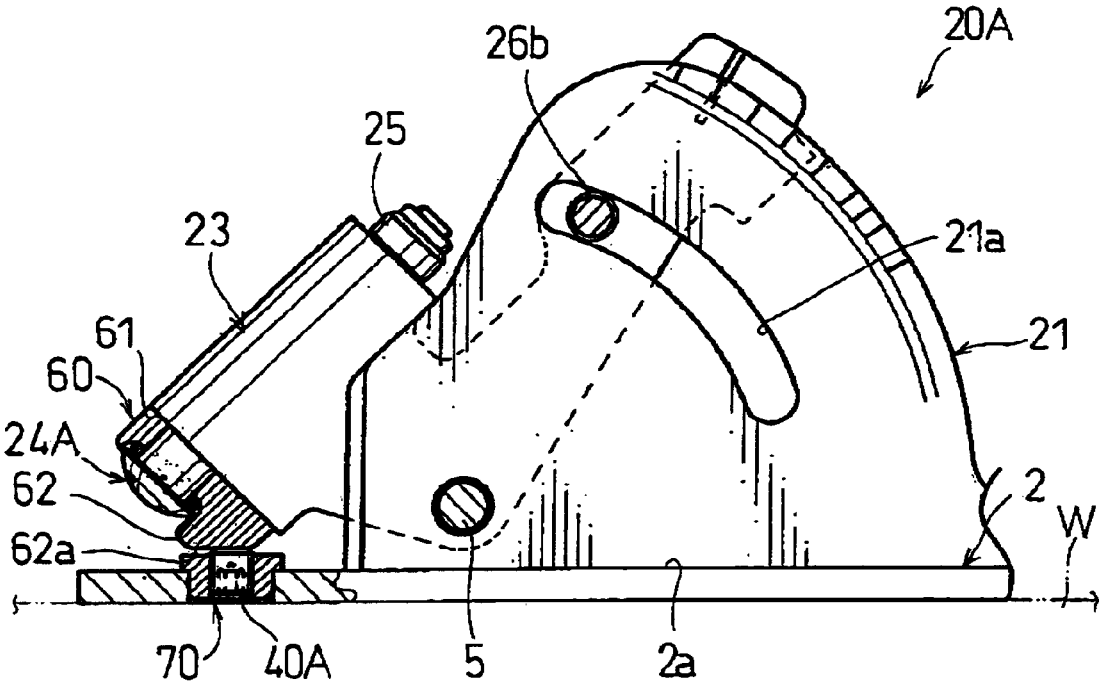
FIG. 15 is a broken away front view of the laterally inclining device when the saw unit is in a reference pivoted position.
Figure 24:
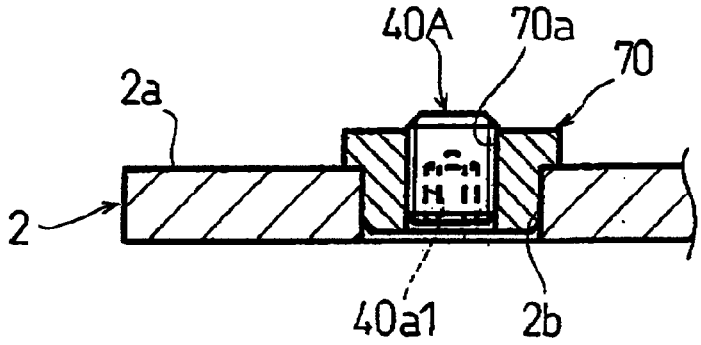
FIG. 24 is a sectional view of a part of the base and a large-angle side adjusting screw mounted on the base.

In the meantime, as shown in FIG. 15, a tubular screw holder 70 may be inserted into a corresponding mounting hole 2*b* (see FIG. 24) formed in the base 2 and may be fixed in position by press-fitting or adhesive bonding. The screw holder 70 may have an upper flange that contacts the upper surface 2*a* of the base 2. As shown in FIG. 24, the screw holder 70 may have a threaded hole 70*a* that is formed in the screw holder 70 in the vertical direction. The adjusting screw 40A may engage the threaded hole 70*a*, so that an upper end of the adjusting screw 40A protrudes upward of the upper surface of the flange of the screw holder 70. A hexagonal recess 40*a*1 may be formed in the lower end of the adjusting screw 40A, so that an appropriate tool (not show) may engage the hexagonal recess 40*a*1 from the side below the base 2 for rotating the adjusting screw 40A. Therefore, the level of the upper end of the adjusting screw 40*a*1 can be finely adjusted.

The mounting position of the tubular screw holder 70 or the position of the mounting hole 2*b* may be determined, such that the inclined surface 62*a* of the stopper member 60 can contact the upper end of the adjusting screw 40A in a surface-to-surface contact relationship therewith when the stopper member 60 is in the operative position.

Although in this representative embodiment, the threaded hole 70*a* that engages the adjusting screw 40A is formed in the screw holder 70, the threaded hole 70*a* may be directly formed in the base 2. However, because the base 2 is normally made of a thin plate such as a steel plate, e.g. a stainless steel plate, a threaded hole that is formed in such a thin plate cannot have a sufficient effective length. Thus, the screw holder 70 of this representative embodiment is advantageous to provide a sufficient effective length of the threaded hole 70*a* in case that the adjusting screw 40A is to be mounted on a base that has a thin thickness. On the other hand, if a base is a die-cast product, e.g. an aluminum die-cast product, the threaded hole 70*a* may be directly formed in the base with sufficient effective length by providing a thickened peripheral portion about the threaded hole 70*a*.

In the same manner as the first representative circular saw, the pivoted position of the saw unit 4 of the second representative circular saw can be reliably and rapidly changed from the 0° position to either the 45° position or the 50° position.

Thus, in order to change the saw unit 4 from the 0° position to the 45° position, the operator may set the stopper member 60 to the operative position by rotating the tab 63, so that the extension 62 is oriented downward toward the base 2 as shown in FIGS. 12 and 13. Then, he or she pivots the saw unit 4 from the 0° position, so that the joint plate 23 pivots about the pivotal support 5 in the counterclockwise direction as viewed in FIG. 12. When the inclined surface 62*a* of the stopper member 60 contacts the upper end of the adjusting screw 40A as shown in FIG. 15, the saw unit 4 reaches the 45° position and cannot pivot further. Then, the operator tightens the lock screw 26, so that the saw unit 4 can be fixed in the 45° position or the reference pivoted position. As a result, the operator can perform a bevel cutting operation of the workpiece W with the saw unit 4 or the saw blade 3 inclined relative to the workpiece W by an angle of 45°.

Figure 17:
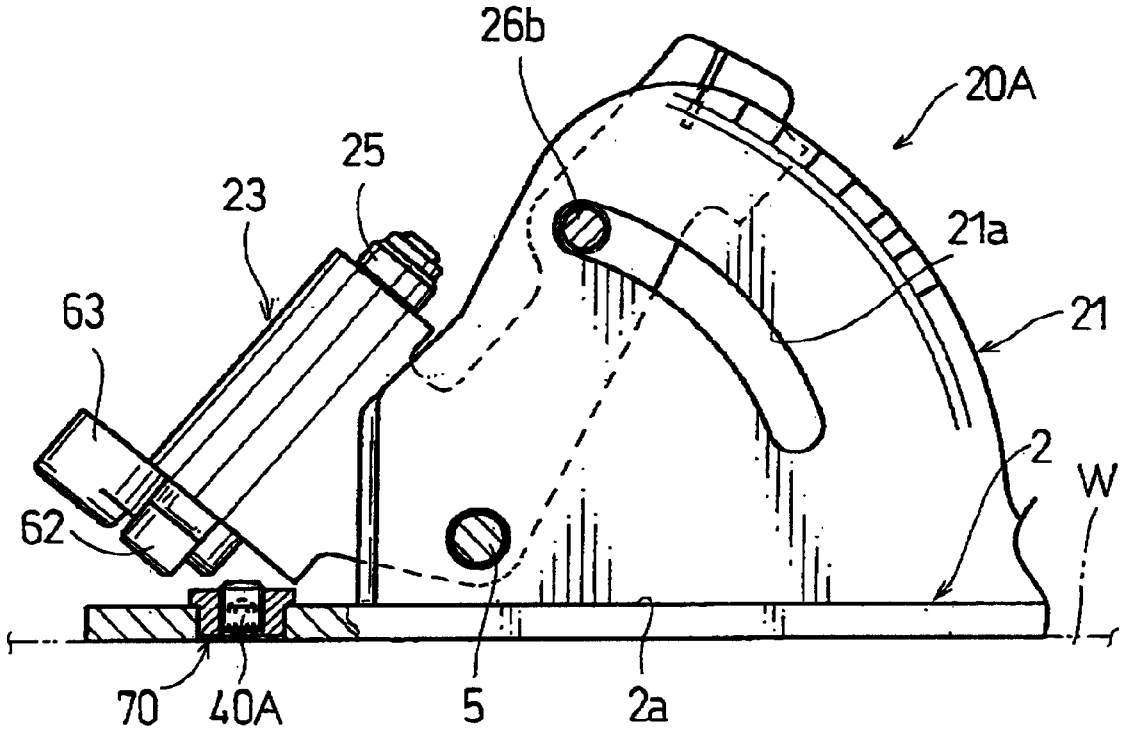
FIG. 17 is a broken away sectional view of the laterally inclining device when the saw unit is in the extra inclined position.

In order to change the saw unit 4 from the 0° position to the 50° position, the operator sets the stopper member 60 in the non-operative position by means of the tab 63. In the non-operative position, the extension 62 is oriented forwardly, while the tab 63 is oriented vertically upward as shown in FIG. 16. Then, he or she loosens the lock screw 26 and pivots the saw unit 4 from the 0° position, so that the joint plate 23 pivots about the pivotal support 5 past the 45° pivoted position. In the same manner as the first representative embodiment, when the threaded shank 26*b* of the lock screw 26 contacts the upper end of the guide slot 21*a* of the guide plate 21 as shown in FIG. 17, the saw unit 4 is stopped at the 50° position or the extra maximum pivoted position. Then, the operator tightens the lock screw 26, so that the saw unit 4 can be fixed in the 50° position. As a result, the operator can perform a bevel cutting operation of the workpiece W with the saw unit 4 or the saw blade 3 inclined relative to the workpiece W by an angle of 50°.

In order to return the saw unit 4 from the 45° position or the 50° position to the 0° position, the operator rotates the stopper member 60 to the non-operative position by means of the tab 63. The lock screw 26 is then loosened and the saw unit 4 is pivoted toward the 0° position, so that the saw unit 4 can be set to the 0° position in the same manner as explained in connection with the first representative embodiment. Then, the operator tightens the lock screw 26, so that the saw unit 4 can be fixed in the 0° position as shown in FIG. 12. As a result, the operator can perform a normal vertical cutting operation of the workpiece W.

Also in the second representative embodiment, the stopper member 60 can rotate relative to the head 24*a* of the bolt 24, and the rotational position of the stopper member 60 can be reliably maintained by the frictional force produced by the O-ring 50A. Therefore, the set position may not be unintentionally or accidentally displaced even if the circular saw vibrates, which may be caused by the cutting operation.

In addition, fine adjustment of the reference pivoted position or the 45° position can be performed by adjusting the driving amount of the adjusting screw 40A into the screw holder 70.

Thus, according to the second representative embodiment of the circular saw, the same operation and effect as the first representative embodiment can be attained. In addition, the second representative embodiment is advantageous over the first representative embodiment, because the operation of the adjusting screw 40A can be performed even when the adjusting screw 40A is in contact with the stopper member 60. Thus, the operator can rotate the adjusting screw 40A from the lower side of the base 2. Therefore, the adjusting operation can be effectively performed.

In accordance with the second representative embodiment, the operator is not required to pivot the saw unit 4 before performing the operation of the adjusting screw 40A. Rather, the saw unit 4 automatically pivots in response to a change in the driving amount of the adjusting screw 40A if the lock screw 26 has been loosened. (When the saw unit 4 has reached the 45° position, the set position can be maintained by the weight of the saw unit 4.)

In addition, according to the second representative embodiment, the rotary shifting operation of the stopper 60 between the operative position and the non-operative position can be easily performed while grasping the tab 63 formed on the stopper 60. The second representative embodiment is advantageous also in this respect.

A third representative embodiment of a circular saw will now be described with reference to FIGS. 25 to 37. The circular saw of this representative embodiment is a modification of the first representative embodiment. Therefore, in the third representative embodiment, like members are given the same reference numerals as the first representative embodiment.

Figure 25:
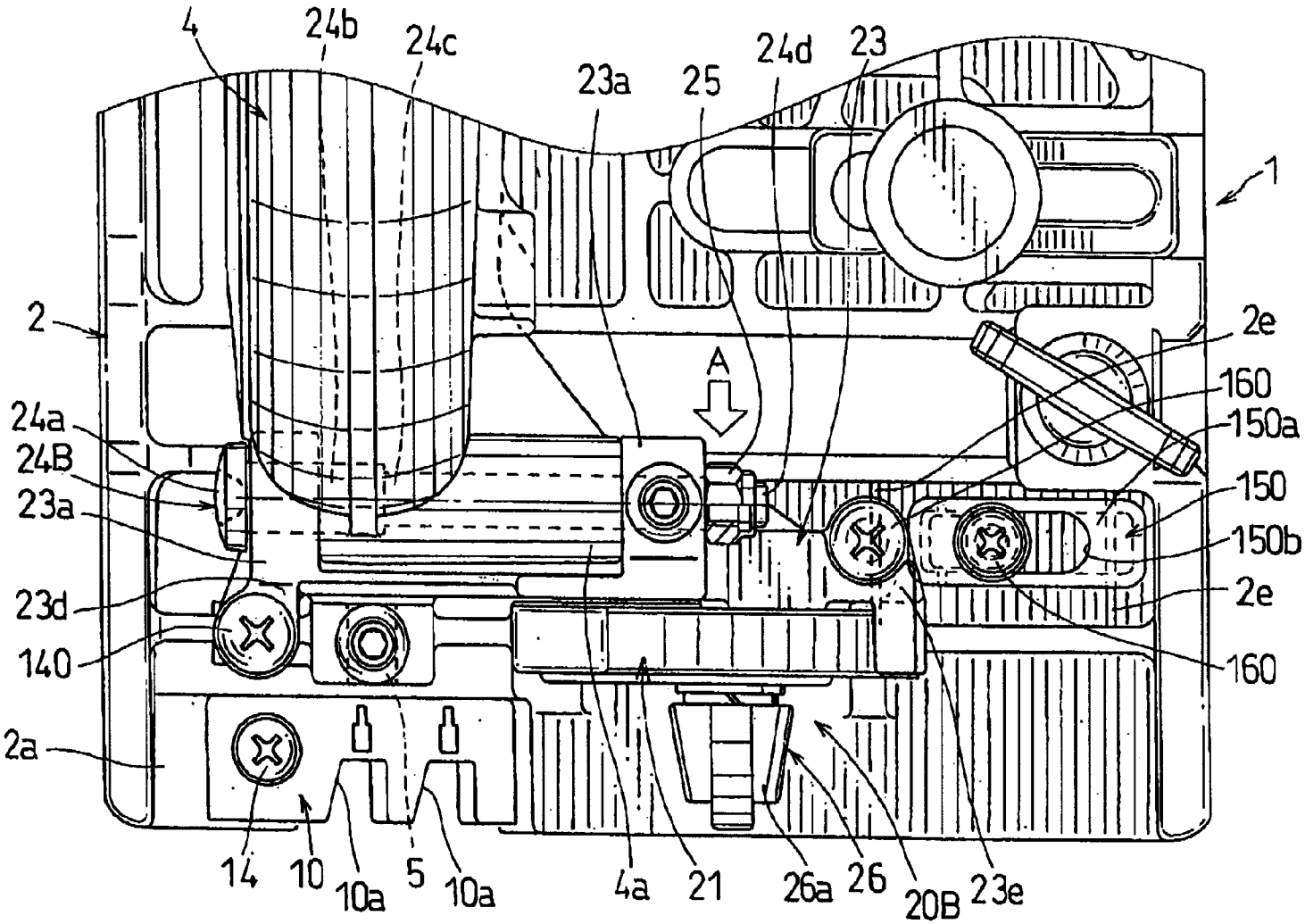
FIG. 25 is a plan view of a front portion of a circular saw according to a third representative embodiment of a circular saw.
Figure 26:
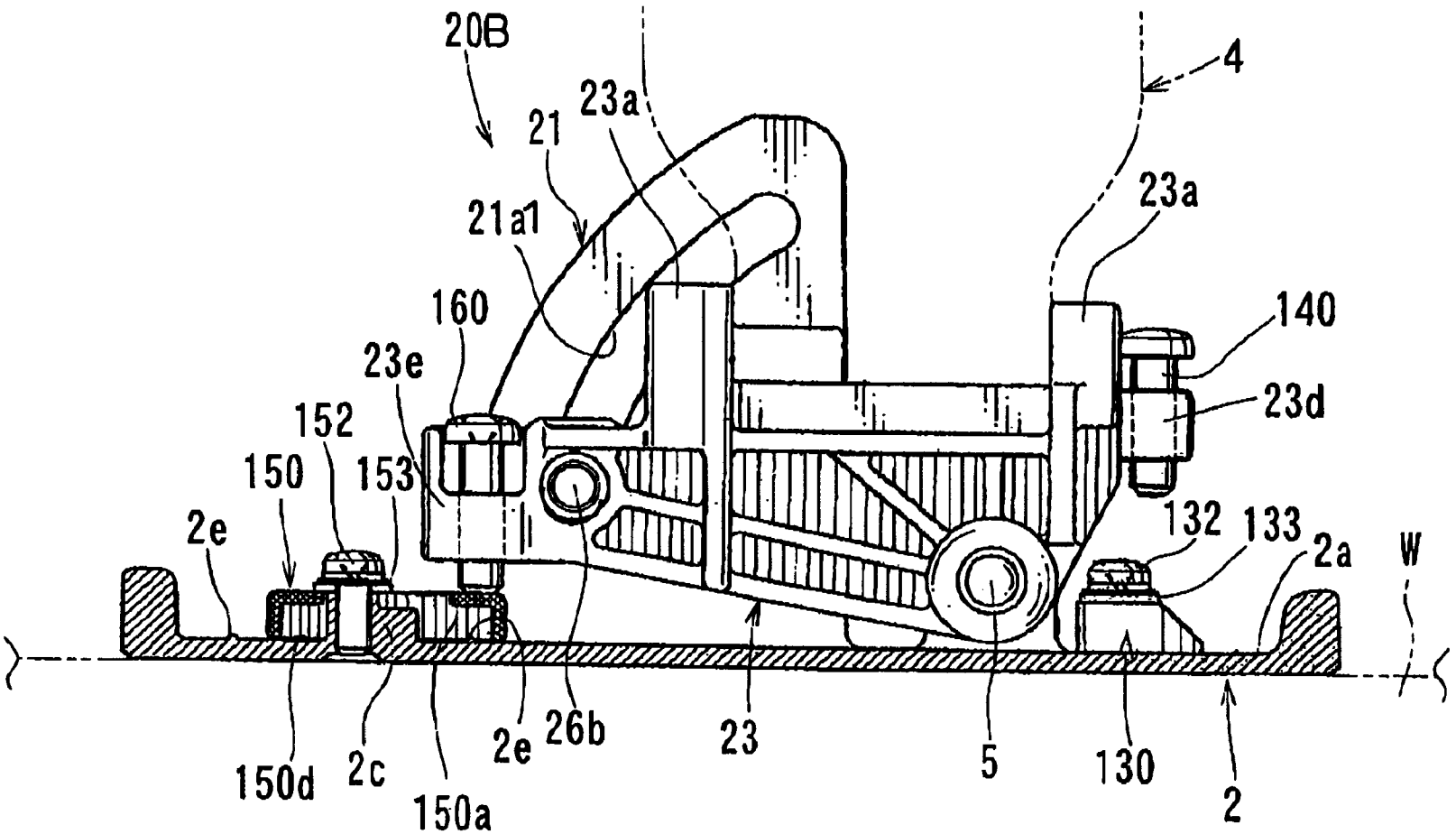
FIG. 26 is a view of a laterally inclining device as viewed in the direction of arrow A in FIG. 25.

A laterally inclining device 20B of the third representative embodiment is shown in FIGS. 25 and 26 in a plan view and a broken away view as viewed from the direction of arrow A in FIG. 25, respectively.

As shown in FIG. 25, in the same manner as the first representative embodiment, the boss portion 4*a* of the saw unit is fitted between the support lugs 23*a* of the joint plate 23 and is vertically pivotally supported by the support lugs 23*a* by means of a bolt 24B that engages the nut 25. However, in the third representative embodiment, the large diameter shaft portion 24*b* of the bolt 24B is rotatably received within the left side support lug 23*a* and also within a left side part of the insertion hole formed in the boss portion 4*a* of the saw unit 4. In addition, the small-diameter shaft portion 24*c* is rotatably received within the right side support lug 23*a* and also within a right side part of the insertion hole of the boss portion 4*a*. Further, no stopper member is mounted on the bolt 24B, and therefore, the head 24*a* of the bolt 24B directly opposes the left side support lug 23*a*.

Further, in the third representative embodiment, a guide slot 21*a*1 that corresponds to the guide slot 21*a* of the first representative embodiment may be formed in the guide plate 21. The guide slot 21*a*1 may have a length that defines the movable range of the lock screw 26, which movable range is greater than the movable range of the lock screw 26 according to the first representative embodiment. More specifically, the guide slot 21*a*1 may allow pivotal movement of the saw unit 4 between a −5° position and the 50° position. Here, the "−5° position" means the laterally pivoted position of the saw unit 4, when the saw unit 4 has been further pivoted by an angle of 5° from the 0° position in a direction opposite to the 45° position or the 50° position. The "−5° position" may also be referred to as a "minus inclined position" in this description.

Figure 28:
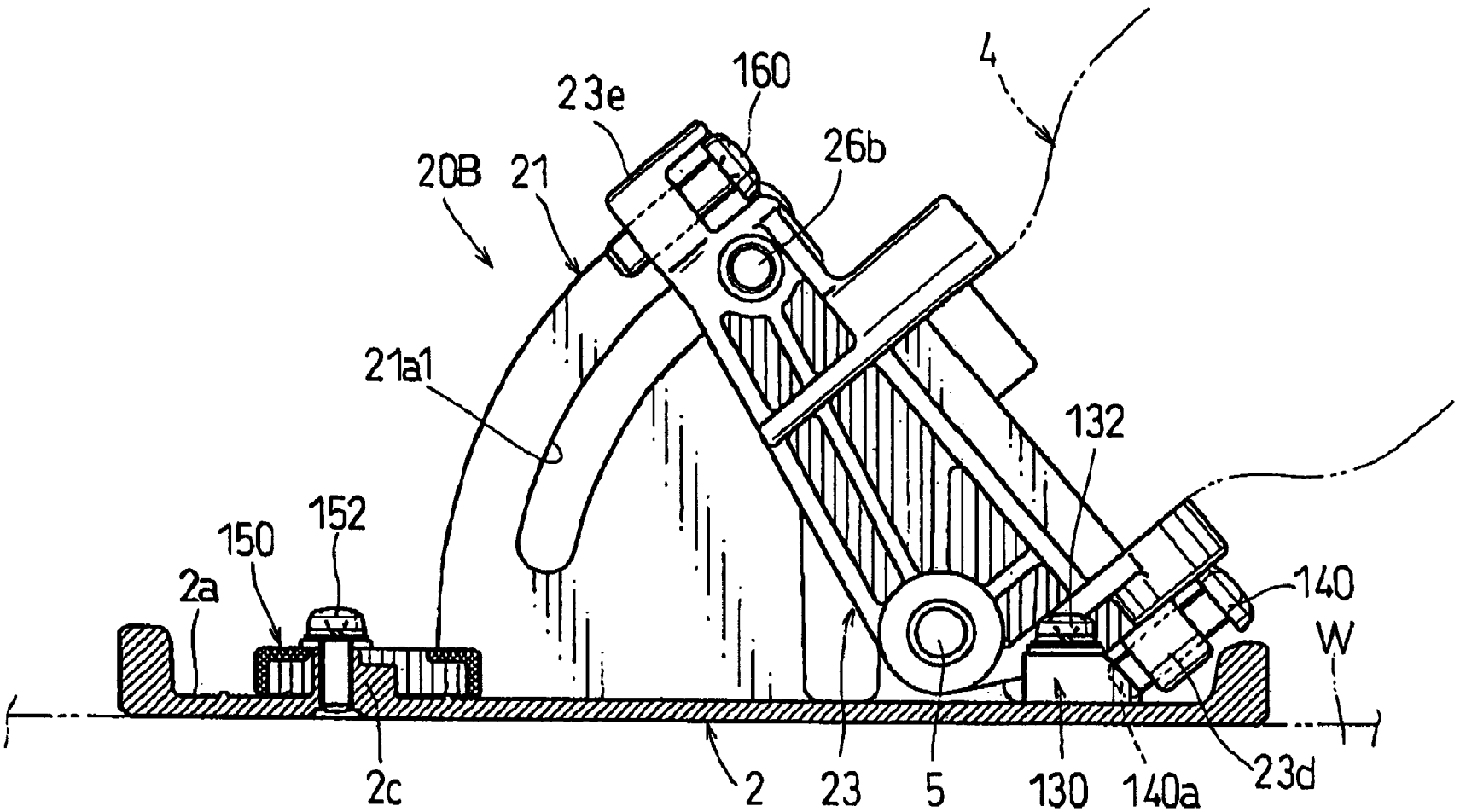
FIG. 28 is a view similar to FIG. 26, but instead showing the laterally inclining device when the saw unit is in an extra pivoted position.
Figure 29:
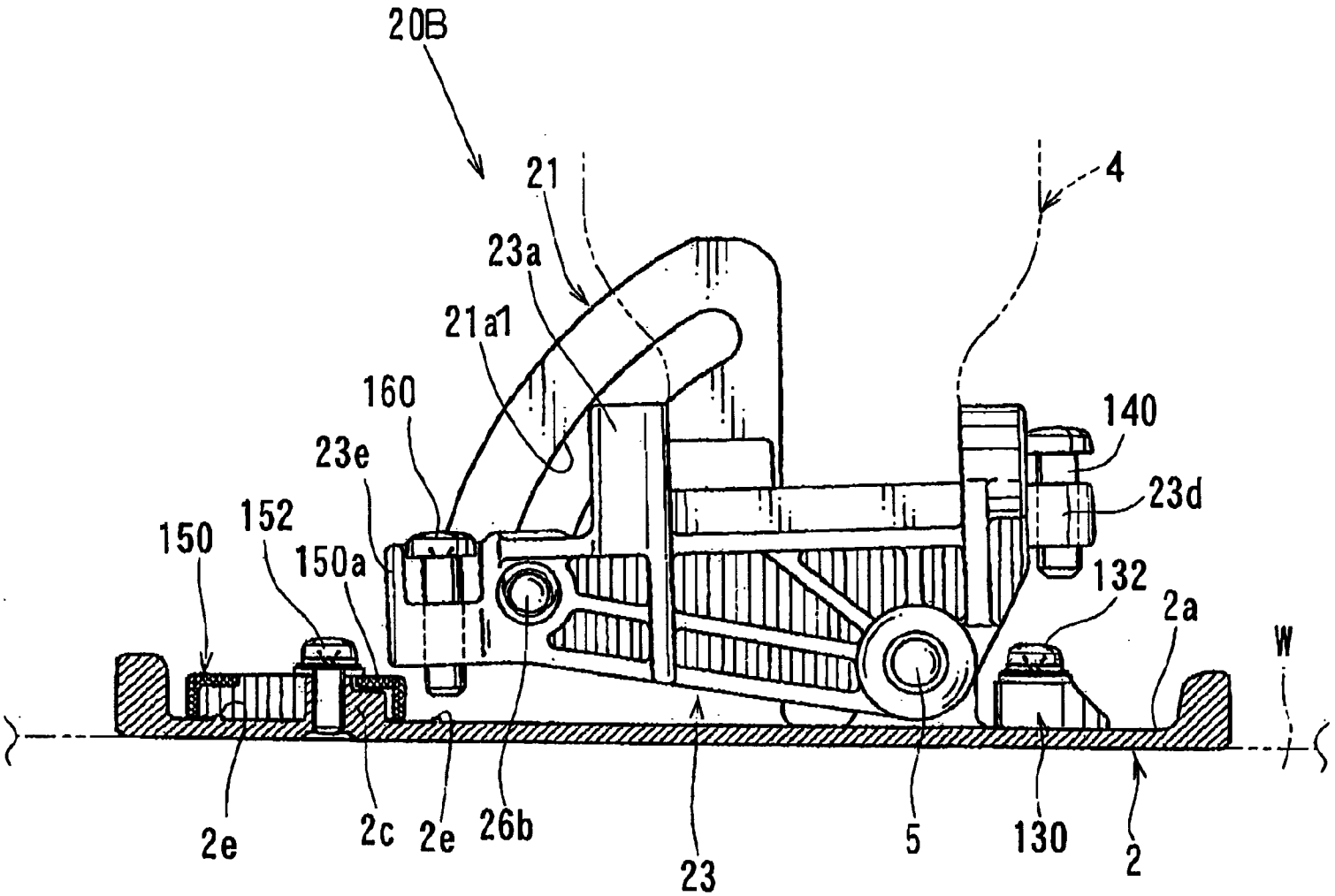
FIG. 29 is a view similar to FIG. 26, but instead showing the laterally inclining device when the saw unit is in a minus pivoted position.

Thus, in the same manner as the first representative embodiment, the laterally inclining device 20B of the third representative embodiment enables the saw unit 4 to cut, for example, in either the 0° position as shown in FIGS. 25 and 26, the 45° position as shown in FIG. 28 that corresponds FIG. 26, or the 50° position as shown in FIG. 28. In addition, the laterally inclining device 20B of the third representative embodiment also enables "edge cutting" operations, which is performed with the saw unit 4 set to the −5° position as shown in FIG. 29 that corresponds to FIG. 26.

The laterally inclining device 20B of the third representative embodiment may include a large-angle side stopper member 130 and a small-angle side stopper member 150 that are disposed on the base 2.

The laterally inclining device 20B also may include a large-angle side adjusting screw 140 and a small-angle side adjusting screw 160 that are mounted on the joint plate 23. The large-angle side adjusting screw 140 and the small-angle side adjusting screw 160 are adapted to cooperate with the large-angle side stopper member 130 and the small-angle side stopper member 150 so as to determine the 45° position or the reference position and the 0° position of the saw unit 4, respectively.

As shown in FIG. 25, a protrusion 23*d* may be integrally formed with the left side support lug 23*a* of the joint plate 23 and may extend forwardly (downwardly as viewed in FIG. 25). (FIG. 26 shows the rear view of the laterally inclining device 23B and the protrusion 23*d* is shown on the right side of FIG. 26.) The large-angle side adjusting screw 140 may engage the protrusion 23*d* and may extend substantially vertically when the saw unit 4 is in 0° position or the vertical position as shown in FIG. 26. As shown in FIG. 26, the large-angle side adjusting screw 140 may have a lower end that extends downward from the protrusion 23*d*.

On the other hand, as shown in FIG. 25, a screw mount 23*e* may be formed on the right side of the joint plate 23 in place of the stopper member 23*c* (see FIG. 5) of the first representative embodiment. In FIG. 26, the screw mount 23*e* may be disposed on the left side of the joint plate 23.

The small-angle side adjusting screw 160 may engage the screw mount 23*c* and may extend substantially vertically when the saw unit 4 is in the vertical position as shown in FIG. 26. As shown in FIG. 26, the large-angle side adjusting screw 160 may have a lower end that extends downward from the screw mount 23*e*. Further, the large-angle side stopper member 130 and the small-angle side stopper member 150 may be positioned to oppose the lower ends of the large-angle side adjusting screw 140 and the small-angle side adjusting screw 160, respectively.

Figure 30:
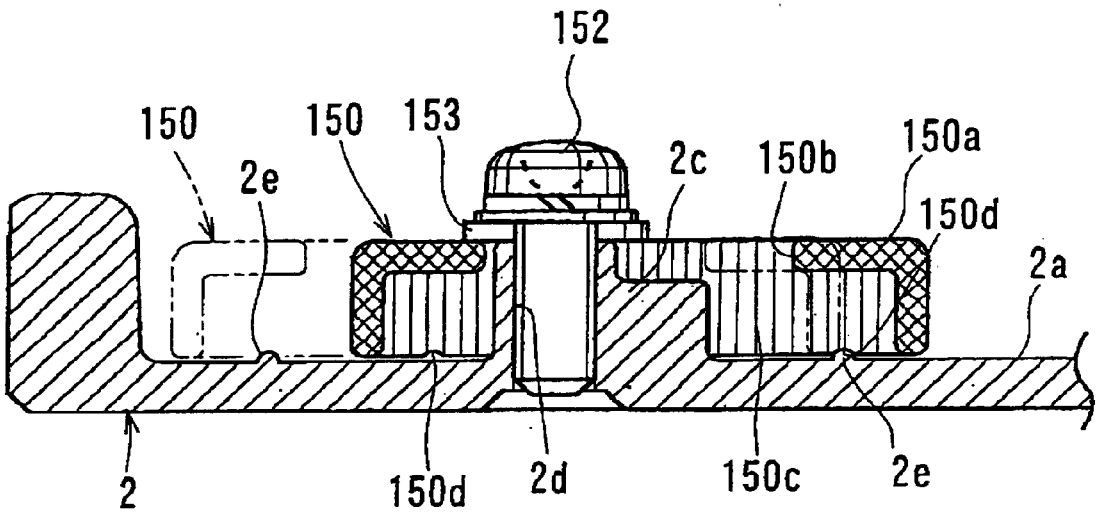
FIG. 30 is a front sectional view of a part of a base and a small-angle side stopper member of the laterally inclining device.
Figure 31:
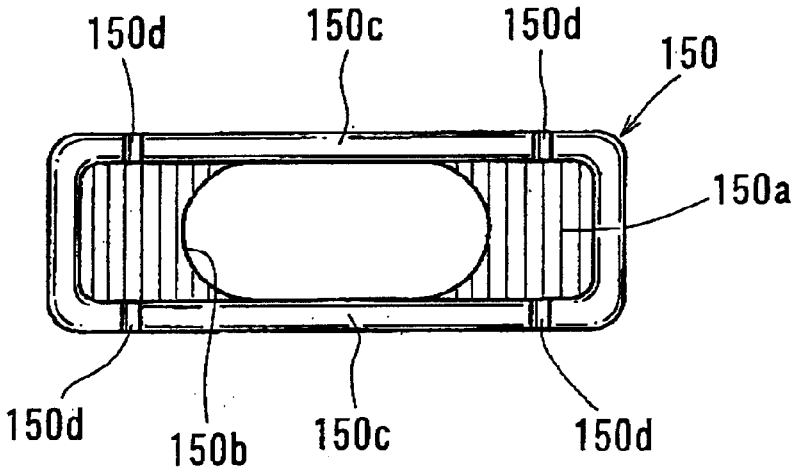
FIG. 31 is a bottom view of the small-angle side stopper member.

The small-angle side stopper member 150 will now be explained in further detail. In FIG. 30, a front sectional view of the small-angle side stopper member 150 is shown together with a part of the base 2. A bottom view of the small-angle side stopper member 150 is shown in FIG. 31. As shown in FIGS. 30 and 31, the small-angle side stopper member 150 may have a substantially hollow rectangular configuration with an open bottom and may preferably be formed by injection molding a plastic material. The small-angle side stopper member 150 may include an upper plate portion 150*a* with an elongated slot 150*b*, which slot extends in the longitudinal direction of the upper plate portion 150*a*. In addition, the small-angle side stopper member 150 may include a pair of front and rear side walls 150*c*, each having a lower edge with right and left side depressions 15*d* formed therein.

On the other hand, as shown in FIG. 30, a boss portion 2*c* with a vertical threaded hole 2*d* may be formed integrally with the upper surface 2*a* of left side portion of the base 2 as viewed in FIG. 26. Preferably, the height of the boss portion 2*c* may be slightly less than the height of the small-angle side stopper member 150. In addition, a pair of parallel ribs 2*e* may be formed on the upper surface 2*a* of the base 2 on both sides of the boss portion 2*c* and may extend in the front and rearward directions as shown in FIG. 25.

The small-angle side stopper member 150 may be mounted on the base 2 in such a manner that the lower portion of the small-angle side stopper member 150 slidably contacts the upper surface 2*a* of the base 2 and the elongated slot 150*b* receives the upper end of the boss portion 2*c*. Therefore, the small-angle side stopper member 150 can slide between an operative position and a non-operative position that are indicated by solid lines and chain lines in FIG. 30, respectively, under the guide of the upper end of the boss portion 2*c*. A fixing screw 152 may engage the threaded hole 2*d* formed in the boss portion 2*c* with a washer 153 interposed between the head of the fixing screw 152 and the boss portion 2*c*. The diameter of the washer 153 may be determined to be slightly greater than the width of the elongated slot 150*b*. Therefore, the small-angle side stopper member 150 may be fixed in position relative to the boss portion 2*c* or the base 2 by tightening the screw 152.

When the small-angle side stopper member 150 is in the operative position, one of the depressions 150*d* of each side wall 150*c* on the right side as viewed in FIG. 30 may engage the right side rib 2*e* of the base 2. Therefore, the small-angle side stopper member 150 may be reliably held in the operative position. When the small-angle side stopper member 150 is in this position, the small-angle side adjusting screw 160 can abut the upper surface of the upper plate portion 150*a* when the saw unit 4 pivots to the 0° position. The 0° position can be finely adjusted by rotating the adjusting screw 160 using an appropriate tool (not shown).

On the other hand, when the small-angle side stopper member 150 is the non-operative position, another depression 150*d* of each side wall 150*c* may engage the left side rib 2*e* of the base 2. Therefore, the small-angle side stopper member 150 may be reliably held in the non-operative position. When the small-angle side stopper member 150 is in this position, the small-angle side adjusting screw 160 will not abut the upper surface of the upper plate portion 150*a* as the saw unit 4 pivots. In other words, the small-angle side stopper member 150 is positioned away from the moving path of the small-angle side adjusting screw 160.

The large-angle side stopper member 130 will now be explained in further detail. The large-angle side stopper member 130 may have a substantially hollow rectangular configuration with an open bottom (see FIG. 27) and may preferably be formed by injection molding a plastic material. The large-angle side stopper member 130 may have an upper plate portion 130*a* that has an inclined surface 130*e* formed on the right side as viewed in FIG. 27. The large-angle side stopper member 130 can slide in the forward and rearward directions relative to the base 2. To this end, a boss portion 2*f* may be formed integrally with the upper surface 2*a* of the right side portion of the base 2 as viewed in FIG. 27. The large-angle side stopper member 130 may be fitted over the boss portion 2*f* and may have a lower portion that slidably contacts the upper surface 2*b* of the base 2. An elongated slot 130*b* may be formed in the upper plate portion 130*a* and may extend in the forward and rearward directions. The elongated slot 130*b* may receive an upper end of the boss portion 2*f*, so that the large-angle side stopper member 130 can slide relative to the base 2 under the guide of the boss portion 2*f* between an operative position and a non-operative position. The large-angle side stopper member 130 can be fixed in position relative to the base 2 by means of a fixing screw 132. The fixing screw 132 may engage a threaded hole formed in the boss portion 2*f*. A washer 133 may be interposed between the head of the fixing screw 132 and the boss portion 2*f* and may have a diameter that is greater than the width of the elongated slot 130*b*.

Figure 27:
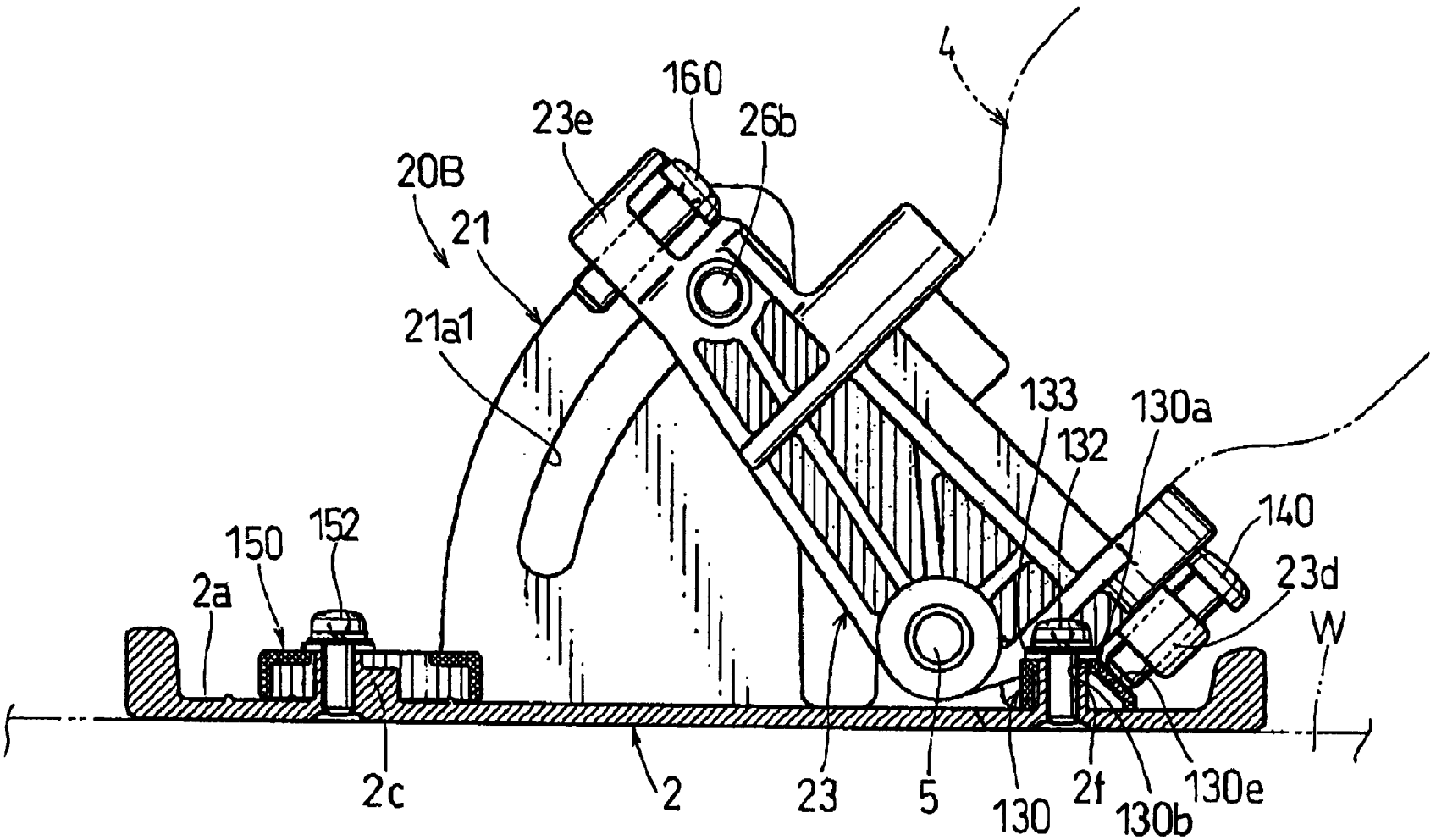
FIG. 27 is a view similar to FIG. 26, but instead showing the laterally inclining device when the saw unit is in a reference position.

When the large-angle side stopper member 130 is in the operative position, the large-angle side adjusting screw 140 can abut the inclined surface 130*e* of the large-angle side stopper member 130 as the saw unit 4 pivots to the 45° position as shown in FIG. 27. The 45° position can be finely adjusted by rotating the adjusting screw 140 using an appropriate tool (not shown).

On the other hand, when the large-angle side stopper member 130 is the non-operative position, the large-angle side adjusting screw 140 will not abut the upper surface of the upper plate portion 150*a* as the saw unit 4 pivots. In other words, the large-angle side stopper member 130 is positioned away from the moving path of the large-angle side adjusting screw 140 (see dotted lines 140*a* in FIG. 28).

In the same manner as explained in connection with the small-angle side stopper member 150, a pair of parallel ribs (not shown) may be formed on the upper surface 2*a* of the base 2 and may serve to engage corresponding depressions (not shown) formed in the lower portion of the large-angle side stopper member 130, so that the large-angle side stopper member 130 can be reliably held in either the operative position or the non-operative position.

As shown in FIG. 25, the third representative embodiment of the circular saw may further include an angle indicator plate 10 that is secured to the front end of the upper surface 2*a* of the base 2 by a screw 14. The angle indicator plate 10 may serve to indicate the lateral pivot angle of the saw unit 4 or the saw blade 3. Two notches 11*a* may be formed in the front end of the angle indicator plate 10 and may serve as references for positioning the workpiece W on the base 2. Thus, the workpiece W may be placed on the base 2 such that the ink line aligns with either one of the notches 10*a*. Of course, only one or three or more notches 10*a* may be formed in the angle indicator plate 10.

Otherwise, an angle indicator plate (not shown) with only one or two notches 10*a* may be mounted on the base 2 such that it can slide on the base 2 in the lateral direction or the left and right directions as viewed in FIG. 25. For example, an angle scale sheet (not shown) may be attached to the base 2, so that the angle indicator plate may be shifted to a position determined according to the scale on the angle scale sheet. This arrangement enables the angle indicator plate to have a small size while allowing indication of a number of ink line angles. Alternatively, an angle scale may be directly marked on the base 2 in place of attaching the angle scale sheet on the base 2.

According to the third representative embodiment of the circular saw, in the same manner as the first representative embodiment of the circular saw, the saw unit 4 can be easily reliably stopped at the reference position or the 50° position when the saw unit 4 has pivoted from the 0° position. In addition, according to the third representative embodiment, the saw unit 4 can be selectively reliably stopped at either the 0° position or the −5° position when the saw unit 4 has pivoted from a pivoted position that is greater than an angle of 0°.

Thus, when the saw unit 4 reaches the 0° position, the lower end of the small-angle side adjusting screw 160 may abut the upper plate portion 150*a* of the small-angle side stopper member 150 in the operative position as shown in FIG. 26, so that the saw unit 4 may be prevented from pivoting from the 0° position toward the −5° position. The saw unit 4 can be fixed in the 0° position by tightening the lock screw 26.

In order to set the saw unit 4 to the 45° position, the operator may set the large-angle side stopper member 130 to the operative position as shown in FIG. 27. Then, he or she loosens the lock screw 26 and pivots the saw unit 4 from the 0° position in the clockwise direction as viewed in FIG. 26, so that the lower end of the large-angle side adjusting screw 140 abuts the inclined surface 130*e* of the large-angle side stopper member 130. As a result, the saw unit 4 can be stopped at the 45° position. The saw unit 4 can be fixed in this position by tightening the lock screw 26, so that a bevel cutting operation can be performed with the saw blade 3 inclined by an angle of 45° relative to the base 2.

In order to set the saw unit 4 to the 50° position, the operator sets the large-angle side stopper member 130 to the non-operative position as shown in FIG. 28. Then, he or she loosens the lock screw 26 and pivots the saw unit 4 from the 0° position in the clockwise direction as viewed in FIG. 26, so that the threaded shank 26*b* of the lock screw 26 may abut the upper end of the guide slot 21*a* in the same manner as the first representative embodiment. As a result, the saw unit 4 can be stopped at the 50° position and can be fixed in this position by tightening the lock screw 26. Therefore, a bevel cutting operation can be performed with the saw blade 3 inclined by an angle of 50° relative to the base 2.

In order to return the saw unit 4 from the 45° position or the 50° position to the 0° position, the operator loosens the lock screw 26 and then pivots the saw unit 4 in a counter-clockwise direction as viewed in FIG. 27 or 28, so that the lower end of the small-angle side adjusting screw 160 may abut the upper plate portion 150*a* of the small-angle side stopper member 150 in the operative position as shown in FIG. 26. As a result, the saw unit 4 can be stopped at the 0° position. The saw unit 4 can be fixed in the 0° position by tightening the lock screw 26, so that a normal cutting operation can be performed.

In order to set the saw unit 4 to the −5° position, the operator sets the small-angle side stopper member 150 to the non-operative position as shown in FIG. 29. Then, he or she pivots the saw unit 4 from the previously set pivoted position, for example, the 45° position or the 50° position, toward the −5° position. Because the small-angle side stopper member 150 is in the non-operative position, the small-angle side adjusting screw 160 will not abut the small-angle side stopper member 150. Therefore, the saw unit 4 can pivot to the −5° position past the 0° position. The pivotal movement of the saw unit 4 is stopped when the threaded shank portion 26*b* of the lock screw 26 abuts the lower end of the guide slot 21*a*1 of the angular plate 21, so that the saw unit 4 may be stopped at the −5° position as shown in FIG. 29. The saw unit 4 can be fixed in the −5° position by tightening the lock screw 26, so that the saw unit 4 in this pivoted position can perform an "edge cutting" operation.

Thus, the laterally stopper mechanism 20B of the third representative embodiment of the circular saw enables the saw unit 4 reliably and accurately set cutting angles in any of the −5°, 0°, 45' and 50° pivoted positions in order to perform cutting operations in different modes. The use of these different cutting modes will now be explained with reference to FIGS. 32 to 37 in connection with the operation for joining two workpieces W to each other.

Figure 32:
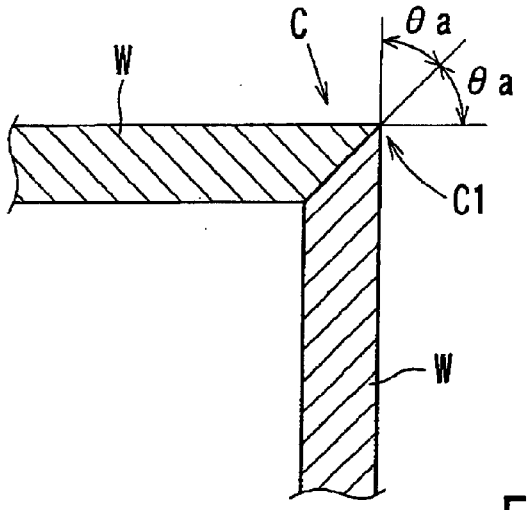
FIG. 32 is a sectional plan view of a corner portion of two workpieces that have been bevel cut at a 45° angle and joined.

FIG. 32 shows an example, in which each of the workpieces W has been cut to have a cut end inclined by an angle of θa. The cut ends of the workpieces W are adapted to be joined to each other to form a joint C1 at a 90° corner portion C of a floor or other similar structure. In this example, the opposing ends are cut by the saw unit 4 with the saw unit set in the 45° position and the angle of θa is set to be 45°.

Figure 33:
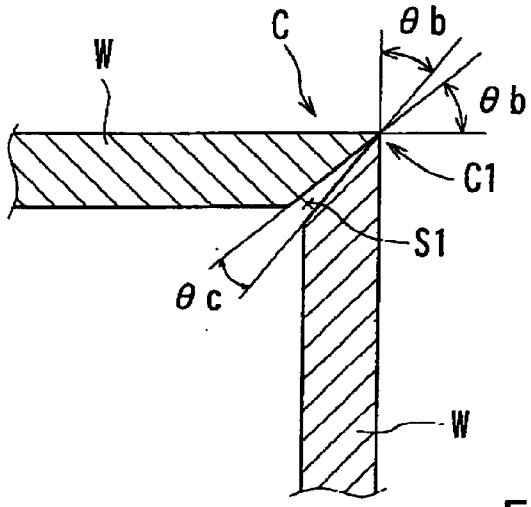
FIG. 33 is a sectional view of a corner portion of two workpieces that have been bevel cut at a 50° angle and joined.

FIG. 33 shows an example, in which each of the workpieces W has been cut to have a cut end inclined by an angle of θb, which angle is different from θa. Similar to the example of FIG. 32, the cut ends of the workpieces W are adapted to be joined to each other to form a joint portion C1 at a 90° corner portion C of a floor or other similar structure. However, in this example, the opposing ends are cut with the saw unit set in the 50° position, so that the angle θb is 40°. Therefore, a gap S1 may be formed in the joint portion C1 between the opposing ends of the workpieces W and may open to the inner side of the corner C by an angle of θc, which may be about 10°.

Figure 34:
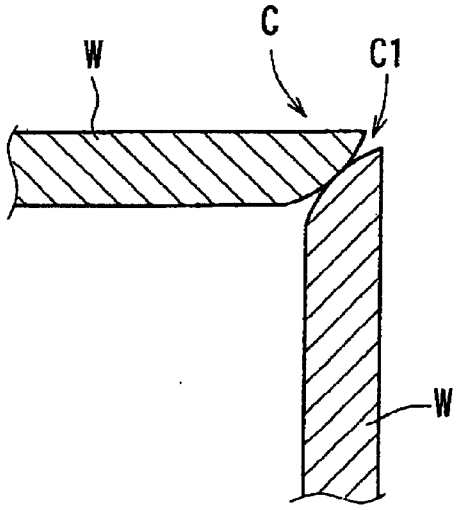
FIG. 34 is a sectional plan view similar FIG. 32, but instead showing the joint ends of the workpieces that have swollen due to atmospheric moisture.

This design is advantageous to maintain a good appearance of the corner C, in particular, if the workpieces W comprise wood or fibrous materials. Thus, if wooden workpieces W have been cut and joined as in the example shown in FIG. 32, the opposing ends may swell due to atmospheric moisture as time passes. As a result, the joint C1 may open on both outer and inner sides of the corner portion C as shown in FIG. 34. In case of the example shown in FIG. 33, the joint C1 may not open on the outer side of the corner portion C even if the opposing ends of the workpieces W have swollen.

Figure 35:
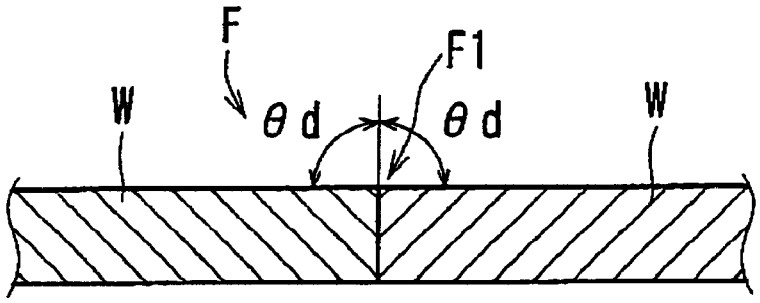
FIG. 35 is a sectional view of a flat portion of two joined workpieces that were vertically cut.

FIG. 35 shows an example, in which each of the workpieces W has been cut to have a cut end with an angle of θd, which may be 90°. The cut ends of the workpieces W are adapted to be joined to each other to form a joint F1 in a flat portion F of a floor or other similar structure. In this example, the saw unit cuts the opposing ends with the saw unit set in the 0° position.

Figure 36:
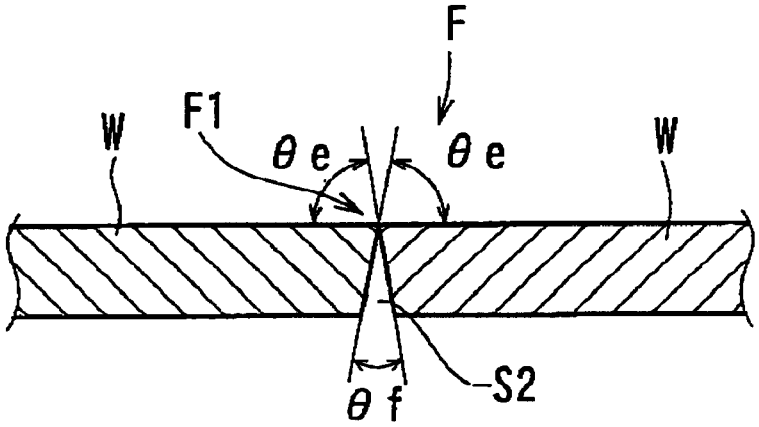
FIG. 36 is a sectional view of a corner portion of two joined workpieces that were cut by the saw unit in a minus pivoted position.
Figure 37:
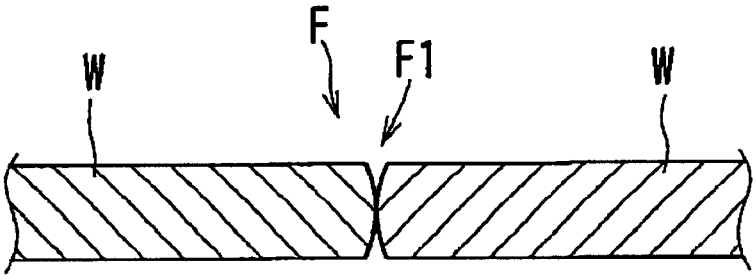
FIG. 37 is a sectional plan view similar FIG. 35, but instead showing the joint ends of the workpieces that have swollen due to atmospheric moisture.

FIG. 36 shows an example, in which each of the workpieces W has been cut to have a cut end inclined by an angle of θe. Similar to the example of FIG. 35, the cut ends of the workpieces W are adapted to be joined to each other to form a joint portion F1 in a flat portion F of a floor or other similar structure. However, in this example, the opposing ends are cut with the saw unit set in the −5° position, so that the angle of θe is set to 85°. Therefore, a gap S2 may be formed at the joint F1 between opposite ends of the workpieces W and may open towards the lower side of the flat portion F by an angle of θf, which may be 10°.

Similar to the example shown in FIG. 33, this design is advantageous to maintain a good appearance of the flat portion F, in particular if the workpieces W are made from wood or other water absorbing materials. Thus, if the workpieces W have been cut and joined, as in the example shown in FIG. 35, the opposing ends may swell due to atmospheric moisture as time passes. As a result, the joint F1 may open on both the upper and lower sides of the flat portion F. In the example shown in FIG. 36, the joint F1 generally will not open on the upper side of the flat portion F even if the opposing ends of the workpieces W have swollen.

The features of the third representative embodiment other than the features of the −5° cutting mode described above will now be explained.

In the third representative embodiment of the laterally inclining device 20B, each of the small-angle side stopper member 150 and the large-angle side stopper member 130 can slide along the upper surface 2*a* of the base 2 and can be reliably held in either the operative position or the non-operative position through engagement between the ribs (the ribs 2*e* for the small-angle side stopper member 150) formed on the base 2 and the respective depressions formed in the stopper members 150 and 130 (the depressions 150*d* for the small-angle side stopper member 150). Therefore, the stopper members 150 and 130 may not accidentally move from the operative positions or the non-operative positions even when vibrations have been transmitted to the stopper members during the cutting operation. Of course, the arrangement of the ribs and the depressions may be inverted such that the base 2 has depressions while the stopper members 150 and 130 have ribs.

In addition, fine adjustments of the 45° position and the 0° position can be performed by adjusting the driving amount of the large-angle side adjusting screw 140 and the small-angle side adjusting screw 160, respectively.

Further, also in this third representative embodiment, the operation of the adjusting screws 140 and 160 can be performed from the upper side, even if these screws are abutting the respective stopper members 130 and 150 (see FIGS. 26 and 27). Therefore, the adjusting operations can be easily performed.

A fourth representative embodiment of a circular saw will now be described with reference to FIGS. 38 and 39. This representative embodiment is a modification of the third representative embodiment and is different from the third embodiment only in a position shifting mechanism of the small-angle side stopper member 150. Therefore, like members are give the same reference numerals as the third representative embodiment.

Figure 38:
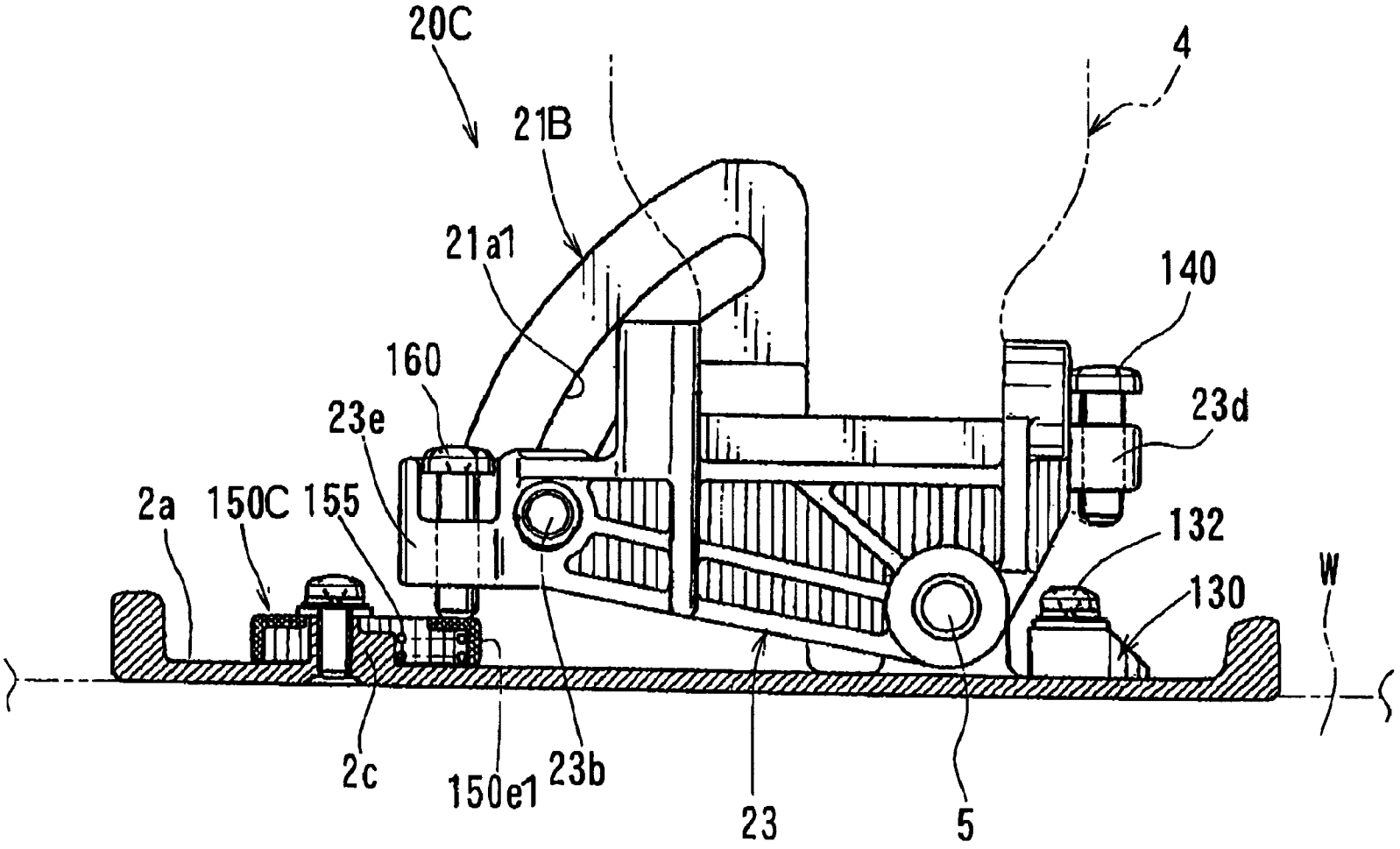
FIG. 38 is a view similar to FIG. 26, but instead showing a laterally pivotal device according to a fourth representative embodiment of a circular saw.

As shown in FIG. 38, which substantially corresponds to FIG. 26 of the third representative embodiment, a laterally inclining device 20C of the fourth representative embodiment may include a small-angle side stopper member 150C that does not have depressions 150*d*, as in the third representative embodiment. In addition, a rib 2*b* is not formed on the base 2. Instead, the laterally inclining device 20C may include a spring 155 that is interposed between the boss portion 2*c* of the base 2 and one of the side walls 150*e1* of the small-angle side stopper member 150C, so that the small-angle side stopper member 150C may be biased toward the operative position as shown in FIG. 38.

Also in this fourth representative embodiment, the pivoted position of the saw unit 4 can be rapidly and reliably set to either the 0° position or the −5° position by the small-angle side stopper member 150C.

Thus, in order to set the saw unit 4 to the 0° position, the operator pivots the saw unit 4 from the previously set pivoted position toward the 0° position in the counterclockwise direction as viewed in FIG. 38. When the saw unit 4 reaches the 0° position, the small-angle side adjusting screw 160 may abut the upper plate portion of the small-angle side stopper member 150C, so that the pivotal movement of the saw unit 4 may stop at the 0° position.

Figure 39:
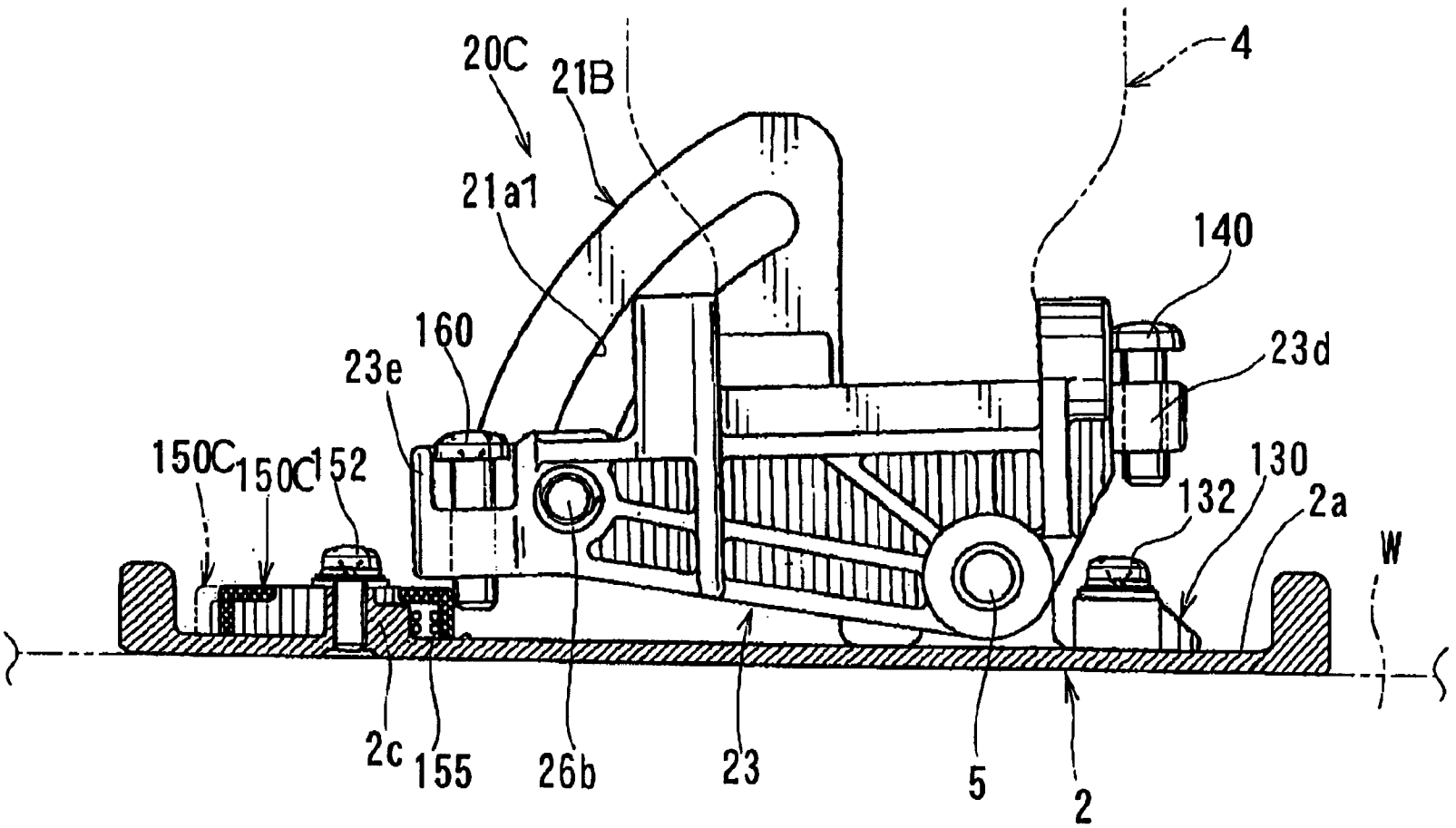
FIG. 39 is a view similar to FIG. 38 and showing the laterally pivotal device when the saw unit is in a minus pivoted position.

In order to set the saw unit 4 to the −5° position, the operator shifts the small-angle side stopper member 150C from the operative position to the non-operative position and then holds the small-angle side stopper member 150C in the non-operative position as shown in FIG. 39. Thereafter, the operator pivots the saw unit 4 from the previously set pivoted position toward the −5° position in the counterclockwise direction as viewed in FIG. 38. When the saw unit 4 reaches the −5° position (i.e. the saw unit 4 moves past the 0° position), the threaded shank 26*b* of the lock screw 26 abuts the lower end of the guide recess 21*a*1 of the angular plate 21B. As a result, the pivotal movement of the saw unit 4 may stop at the −5° position in the same manner as explained in connection with the third representative embodiment.

After the saw unit 4 has reached the −5° position, the small-angle side stopper member 150C does not move to the operative position even if the operator releases the small-angle side stopper member 150C. Thus, although the small-angle side stopper member 150C is biased toward the operative position by the restoring force of the spring 155, it may abut the lateral side of the lower end of the small-angle adjusting screw 160 and may not move further toward the operative position as indicated by solid lines in FIG. 39. However, the small-angle side stopper member 150C may automatically return to the operative position if the operator pivots the saw unit 4 in the clockwise direction (as viewed in FIG. 39) so as to set the saw unit 4 to a different pivoted position. Thus, the small-angle side adjusting screw 160 will not interfere with the stopper member 150C.

In other respects, the operations and the advantages are the same as the third representative embodiment.

A fifth representative embodiment of a circular saw will now be described with reference to FIG. 40. This representative embodiment is a modification of the third representative embodiment and is different from the third embodiment only in providing a position shifting mechanism for the large-angle side stopper member 140. Therefore, like members are give the same reference numerals as the third representative embodiment.

Figure 40:
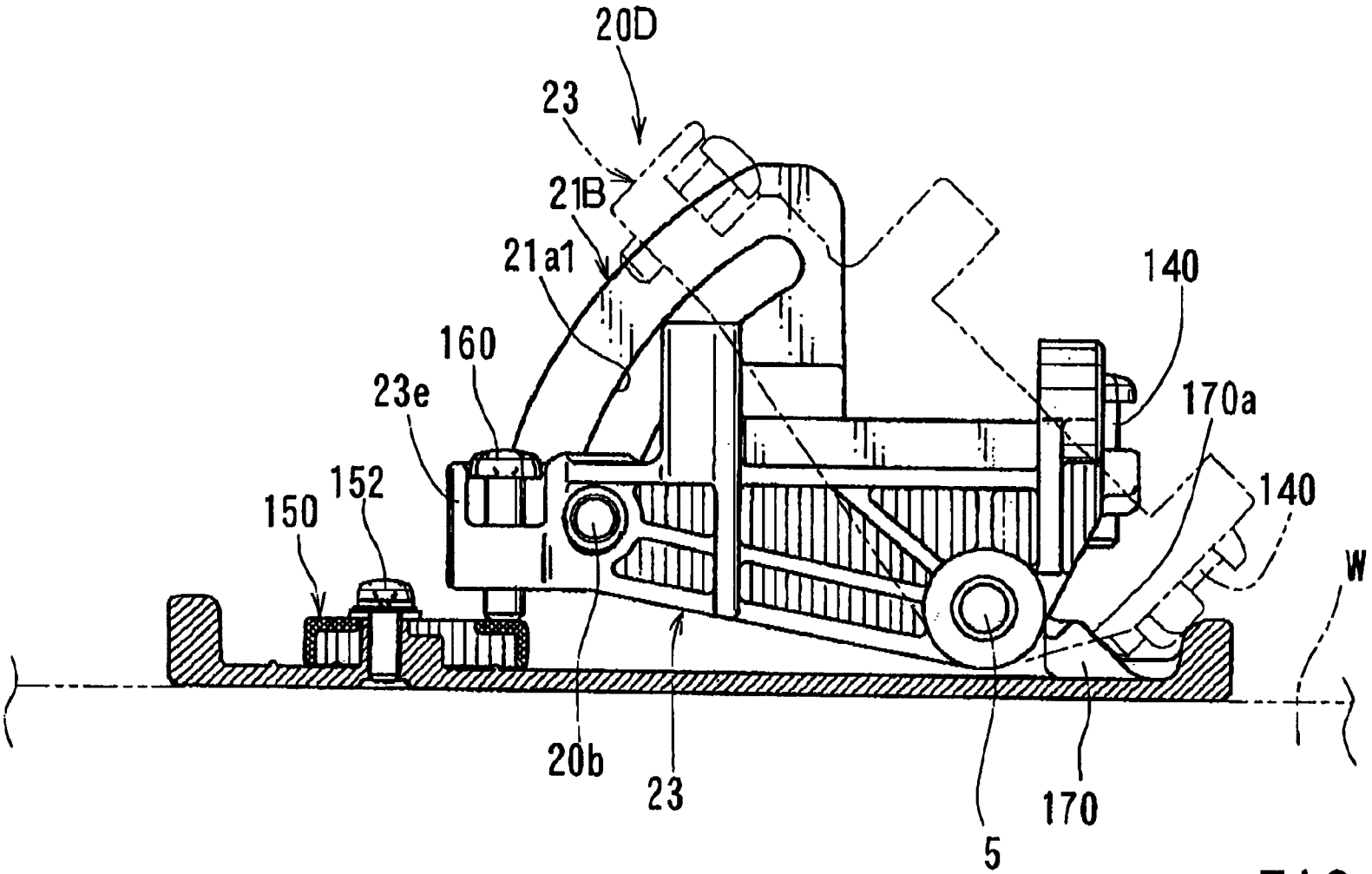
FIG. 40 is a view similar to FIG. 26, but instead showing a laterally pivotal device according to a fifth representative embodiment of a circular saw.
Figure 41:
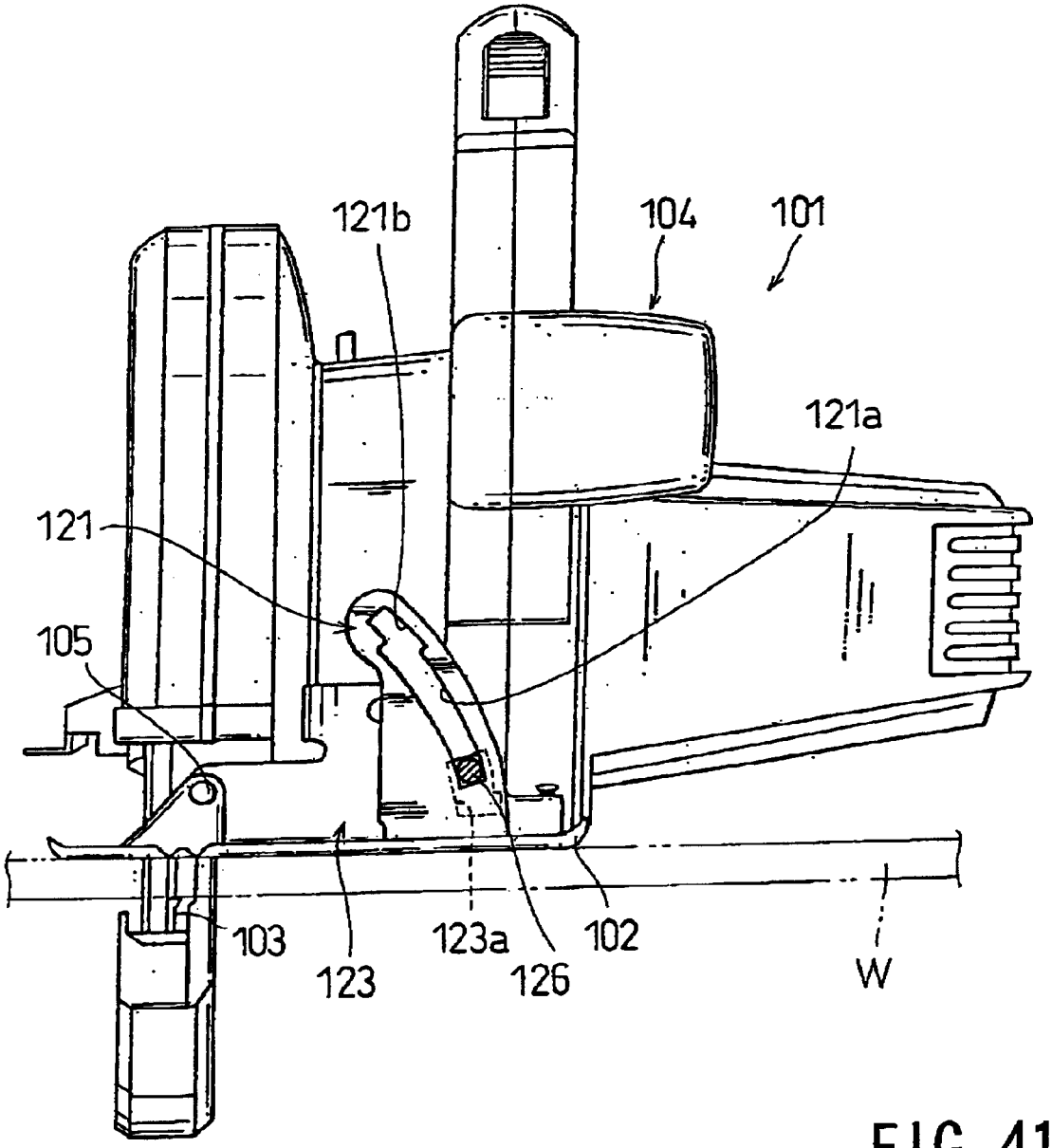
FIG. 41 PRIOR ART
FIG. 41 is a front view of a known circular saw.
Figure 42:
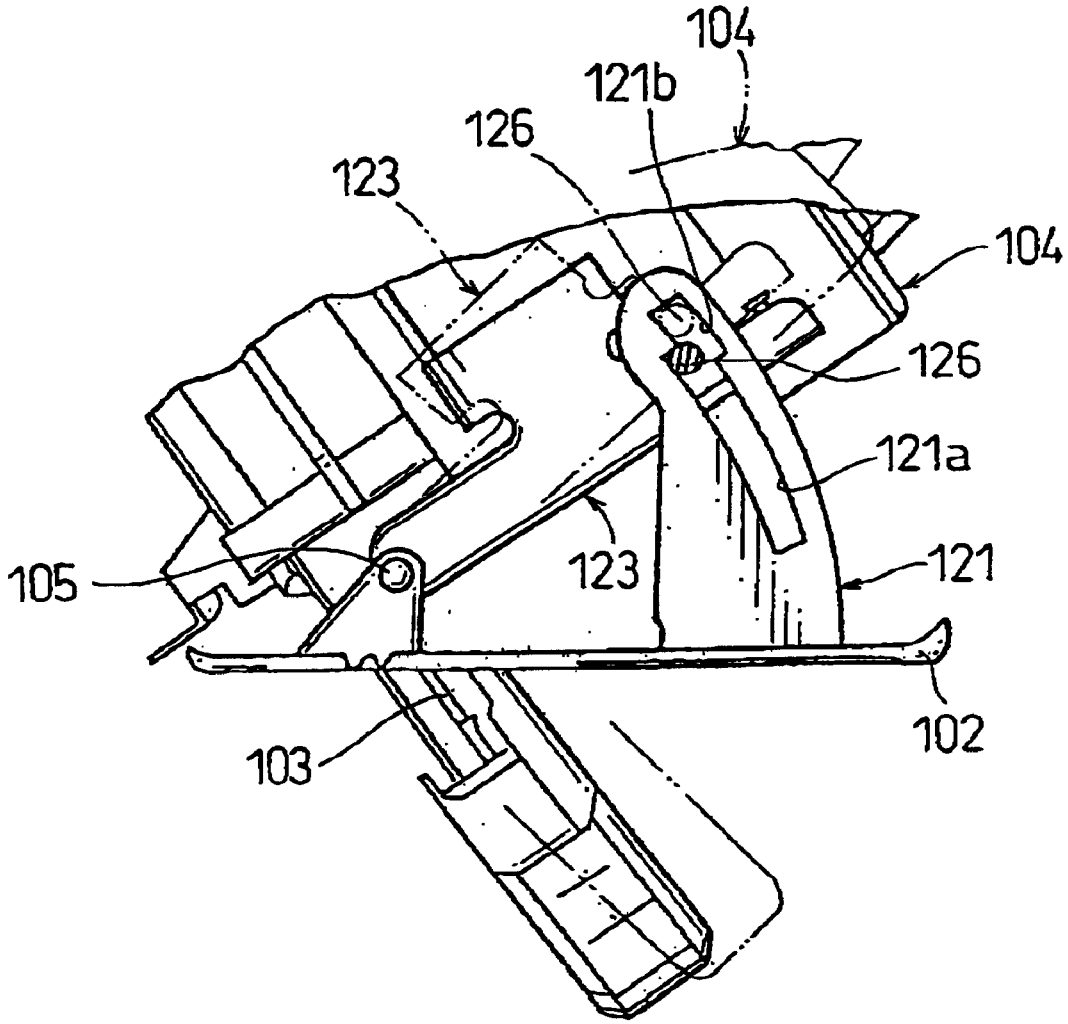
FIG. 42 PRIOR ART
FIG. 42 is a broken away front view of the circular saw shown in FIG. 41.
Figure 43:
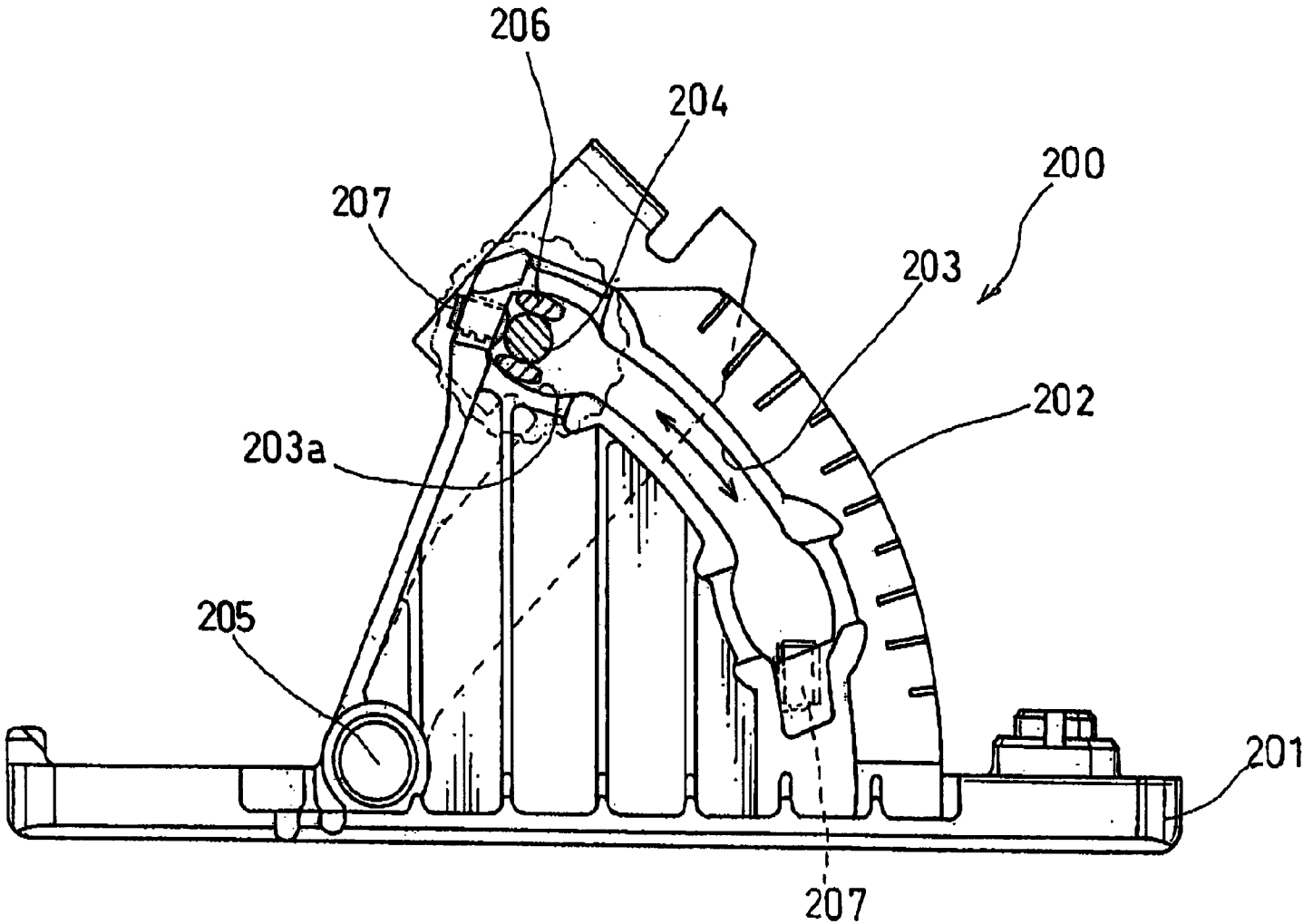
FIG. 43 PRIOR ART
FIG. 43 is a front view of a laterally inclining device of another known circular saw.

As shown in FIG. 40, which substantially corresponds to FIG. 26 of the third representative embodiment, a laterally inclining device 20D of the fifth representative embodiment includes a large-angle side stopper member 170 that may be formed integrally with the upper surface of the base 2. The large-angle side stopper member 170 may include an inclined surface 170*a*, to which the large-angle side adjusting screw 140 can abut. In this representative embodiment, the stopper member 170 cannot shift to selectively determine the 45° position and the 50° position. However, these positions can be set by adjusting the position of the large-side adjusting screw 140 relative to the saw unit 4.

In other respects, the operations and the advantages are the same as the third representative embodiment.

Although the present invention has been described in connection with various representative embodiments of the circular saws that are primarily intended to cut wood workpiece, the present invention can also be applied to the other kind of saws, such as portable cut-off saws for metal working purposes, and cutters for concrete and stone working purpose.

In addition, although in the representative embodiments, the pivoted position can be set to the 0° position, the 45° position, and the 50° position (and −5° position in the third to fifth representative embodiments), such settable pivoted angles may be set to angles that are different from the angles disclosed in the representative embodiments.

Further, the first or second representative embodiment may be modified such that two or more extensions 32 (36) having different extending lengths are formed on the base portions 31 (61) of the stopper members 30 (60) in the circumferential direction. This design enables the operator to selectively determine the reference position from among several different angle positions.

In addition, although in the first and second representative embodiments, the stopper member 30 (60) is mounted on the saw unit 4, it may be mounted on the base 2 in place of the saw unit 4. In addition, a stopper member that is similar to the stopper member 30 (60) also may be mounted on the base 2. Further, although in the first or second representative embodiment, the stopper member 30 (60) rotates between the operative position and the non-operative position, it may be replaced with a stopper member that can linearly slide between an operative position and a non-operative position.

Also in the third representative embodiment, the stopper members 130 and 150 may be mounted on the base 2 in place of the saw unit 4. In addition, although in the third representative embodiment, the stopper members 130 and 150 rotate between the operative position and the non-operative position, they may be replaced by stopper members that can linearly slide between an operative position and a non-operative position.

In the first or second representative embodiments, the stopper member 30 (60) is mounted on the saw unit 4 by utilizing the bolt 24 that serves as a vertical pivot. However, the stopper member may be mounted on the saw unit 4 without utilizing the bolt 24. For example, the stopper member may be mounted on the angular plate 23 by using its own mounting device or by using bolts that are previously provided on the angular plate 23 other than the bolt 24. Further, the stopper member may be integrally formed with the bolt 24 or its own mounting bolt.

Although in the representative embodiments, the adjusting screws 40, 140 and 150 are provided for fine adjustment of the settable pivoted positions, these adjusting screws may be omitted if desired.

Finally, other relevant teachings concerning appropriate stopper mechanisms for portable circular saws are provided in a U.S. patent application Ser. No. 09/637,906 filed on Aug. 14, 2000, naming Toru Fukuoa as the sole inventor, claiming priority to Japanese application No. 11-229929 of Aug. 16, 1999, the contents of which are hereby incorporated by reference.

What is claimed is:

1. A circular saw adapted to be hand held during a cutting operation, comprising:

a base, a saw unit pivotally coupled to the base, wherein the saw unit has a circular saw blade that is adapted to laterally pivot relative to the base and a stopper constructed and arranged to allow an operator to selectively stop the saw unit at a second pivot angle that is between a first pivot angle and a third pivot angle, wherein the stopper has a non-operative position, in which the saw unit can pivot from the first pivot angle to the third pivot angle without stopping at the second pivot angle, and an operative position, in which the saw unit stops at the second pivot angle, wherein the stopper comprises a first stopper member coupled to the base and a second stopper member adapted to laterally pivot in a fixed relationship with the saw unit, wherein the first stopper member and the second stopper member are constructed and arranged to contact each other in order to stop the saw unit at the second pivot angle when the stopper is in the operative position and the first stopper member or the second stopper member are adapted to not to contact each other when the stopper is in the non-operative position, wherein the saw unit can pivot to the third pivot angle.

2. A circular saw as in claim 1, wherein one of the first stopper member and the second stopper member is adapted to shift between a first position, in which the first and second stopper member will contact each other when the saw unit is at the second pivot angle, and a second position in which the first and second stopper member will not contact each other when the saw unit is at the second pivot angle angle.

3. A circular saw as in claim 1, wherein the first stopper member is defined by an upper surface of the base.

4. A circular saw as in claim 1, wherein the first stopper member is adapted to shift along the base between the operative position and the non-operative position.

5. A circular saw as in claim 1, further including means for finely adjusting the position of the first pivot angle or the second pivot angle.

6. A circular saw as in claim 5, wherein the adjusting means comprises a screw that serves as one of the first stopper member or the second stopper member.

7. A circular saw as in claim 1, further including a joint plate that is adapted to laterally pivot relative to the base and to vertically pivotally support the saw unit.

8. A circular saw as in claim 7, wherein the second stopper member is mounted on the joint plate.

9. A circular saw as in claim 7, further comprising a pivot shaft, wherein the saw unit vertically pivots about the pivot shaft with respect to the joint plate and the second stopper member that is mounted on the pivot shaft, wherein the stopper member is adapted to pivot about the pivot shaft between the operative position and the non-operative position.

10. A circular saw as in claim 7, further including a guide plate that is fixedly mounted on the base, and the joint plate is laterally pivotally mounted on the guide plate, the guide plate having a guide slot formed therein.

11. A circular saw as in claim 10, further comprising a lock screw disposed within the guide slot and adapted to fix the saw unit in position between the first pivot angle and the third pivot angle during a cutting operation, wherein terminal ends of the guide slot define the first pivot angle and the third pivot angle.

12. A hand held circular saw comprising:

a base, a saw unit pivotally coupled to the base, wherein the saw unit has a circular saw blade that is adapted to laterally incline relative to the base, a large-angle stopper adapted to define an inclining angle of the saw unit, wherein the saw unit is adapted to selectively stop either at a first maximum angle or a second maximum angle and a small-angle stopper adapted to define an inclining angle of the saw unit, wherein the saw unit is adapted to selectively stop either at a first minimum angle or a second minimum angle, wherein the large-angle stopper comprises:

a first stopper adapted to move with the base;

a second stopper adapted to laterally pivot with the saw unit;

wherein at least one of the first stopper or the second stopper is adapted to move between an operative position, in which the first stopper and the second stopper will contact each other at the first maximum angle and thereby stop the saw unit from further pivoting, and a non-operative position, in which the first stopper and the second stopper will not contact each other at the first maximum angle, thereby permitting the saw unit to pivot past the first maximum angle without interference.

13. A circular saw as in claim 12, wherein the small-angle stopper comprises:

a first stopper adapted to move with the base;

a second stopper adapted to laterally pivot with the saw unit;

wherein at least one of the first stopper or the second stopper is adapted to move between an operative position, in which the first stopper and the second stopper will contact each other at the first minimum angle and thereby stop the saw unit from further pivoting, and a non-operative position, in which the first stopper and the second stopper will not contact each other at the first minimum angle, thereby permitting the saw unit to pivot past the first minimum angle without interference.

14. A circular saw as in claim 13, further comprising a guide slot having first and second terminal ends, wherein the first terminal end defines the second maximum angle and the second terminal end defines the second minimum angle.

15. A circular saw as in claims 14, further comprising a lock screw disposed within the guide slot and adapted to fix the saw unit in position with respect to the base during a cutting operation.

16. A saw comprising:

a base comprising a first pivotal support and a second pivotal support, the first and second pivotal supports defining a pivotal axis, a saw unit comprising a saw blade, the saw unit being pivotally supported by the first and second pivotal supports and being pivotable with respect to the base between a first pivot angle and a third pivot angle, a first stopper coupled to the base or the saw unit, the first stopper being movable between an operative position, in which the saw unit stops at a second pivot angle, which is between the first pivot angle and third pivot angle, and a non-operative position, in which the saw unit can freely pass through the second pivot angle without stopping, further comprising a second stopper coupled to the saw unit or the base, the second stopper being movable between an operative position, in which the saw unit stops at a fourth pivot angle, which is between the first pivot angle and second pivot angle, and a non-operative position, in which the saw unit can freely pass through the fourth pivot angle without stopping.

17. A saw as in claim 16 further comprising: an adjustment screw rotatably disposed within the first stopper, the adjustment screw being arranged and constructed to enable fine adjustment of the second pivot angle.

18. A saw as in claim 16, further comprising:

a guide plate having an elongated, arcuate guide slot defined therein, the guide slot having a first terminal end defining the first pivot angle and a second terminal end defining the third pivot angle, and a lock screw slidably disposed within the guide slot and adapted to contact the first and second terminal ends of the guide slot so as to define the lateral pivotable range of the saw unit with respect to the base.

19. A saw as in claim 18, wherein the lock screw is further arranged and constructed to releasably lock the position of the saw unit with respect to the base.

20. A saw as in claim 19, wherein the guide plate is mounted on the base.

21. A saw as in claim 20, further comprising a joint plate coupled to the guide plate, the joint plate comprising a pair of support lugs, wherein the saw unit is pivotally coupled to to the support lugs, wherein in saw unit can pivot with respect to the base in a direction substantially perpendicular to the base.

22. A circular saw adapted to be hand held during a cutting operation, comprising:

a base, a saw unit pivotally coupled to the base, wherein the saw unit has a circular saw blade that is adapted to laterally pivot relative to the base and a stopper constructed and arranged to allow an operator to selectively stop the saw unit at a second pivot angle that is between a first pivot angle and a third pivot angle, wherein the stopper has a non-operative position, in which the saw unit can pivot from the first pivot angle to the third pivot angle without stopping at the second pivot angle, and an operative position, in which the saw unit stops at the second pivot angle, said circular saw further comprising:

a guide plate having a guide slot, the guide slot having a first terminal end defining the first pivot angle and a second terminal end defining the third pivot angle, a lock screw disposed within the guide slot and adapted to contact the first and second terminal ends of the guide slot so as to define the pivotable range of the saw unit with respect to the base, and a second stopper constructed and arranged to allow an operator to selectively stop the saw unit at a fourth pivot angle, that is between the first pivot angle and the second pivot angle, wherein the second stopper has a non-operative position, in which the saw unit can pivot from the second pivot angle past the fourth pivot angle to the first pivot angle without stopping at the fourth pivot angle, and an operative position, in which the saw unit will stop at the fourth pivot angle.

23. A circular saw as in claim 22, wherein the lock screw is further arranged and constructed to releasably lock the pivot position of the saw unit with respect to the base.

24. A hand-held circular saw comprising:

a base, a saw unit pivotally coupled to the base, wherein the saw unit has a circular saw blade that is adapted to laterally incline relative to the base, a large-angle stopper adapted to define an inclining angle of the saw unit, wherein the saw unit is adapted to selectively stop either at a first maximum angle or a second maximum angle and a small-angle stopper adapted to define an inclining angle of the saw unit, wherein the saw unit is adapted to selectively stop either at a first minimum angle or a second minimum angle, wherein the small-angle stopper comprises:

a first stopper adapted to move with the base;

a second stopper adapted to laterally pivot with the saw unit;

wherein at least one of the first stopper or the second stopper is adapted to move between an operative position, in which the first stopper and the second stopper will contact each other at the first minimum angle and thereby stop the saw unit from further pivoting, and a non-operative position, in which the first stopper and the second stopper will not contact each other at the first minimum angle, thereby permitting the saw unit to pivot past the first minimum angle without interference.

25. A portable circular saw comprising:

a base, a saw unit pivotally coupled to the base, wherein the saw unit has a circular saw blade that can be set in a variety of bevel positions with respect to the base, a guide plate comprising a guide slot, the guide slot having a first terminal end defining a minimum pivot angle and a second terminal end defining a maximum pivot angle, a lock screw disposed within the guide slot and adapted to contact the first and second terminal ends of the guide slot to define the pivotable range of the saw unit with respect to the base, a first stopper constructed and arranged to allow an operator to selectively stop the saw unit at a first pivot angle that is between the minimum pivot angle and the maximum pivot angle, wherein the first stopper has a non-operative position, in which the saw unit can pivot past the first pivot angle to the maximum pivot angle without stopping at the first pivot angle, and an operative position, in which the saw unit will stop at the first pivot angle, and a second stopper constructed and arranged to allow an operator to selectively stop the saw unit at a second pivot angle that is between the minimum pivot angle and the first pivot angle, wherein the second stopper has a non-operative position, in which the saw unit can pivot from the minimum pivot angle past the second pivot angle without stopping at the second pivot angle, and an operative position, in which the saw unit will stop at the second pivot angle.

26. A circular saw adapted to be hand held during a cutting operation, comprising:

a base, a saw unit pivotally coupled to the base, wherein the saw unit has a circular saw blade that is adapted to laterally pivot relative to the base and a stopper constructed and arranged to allow an operator to selectively stop the saw unit at a second pivot angle that is between a first pivot angle and a third pivot angle, wherein the stopper has a non-operative position, in which the saw unit can pivot from the first pivot angle to the third pivot angle without stopping at the second pivot angle, and an operative position, in which the saw unit stops at the second pivot angle, further comprising a second stopper constructed and arranged to allow an operator to selectively stop the saw unit at a fourth pivot angle, that is between the first pivot angle and the second pivot angle, wherein the second stopper has a non-operative position, in which the saw unit can pivot from the second pivot angle past the fourth pivot angle to the first pivot angle without stopping at the fourth pivot angle, and an operative position, in which the saw unit will stop at the fourth pivot angle.

* * * * *